US009065162B2

(12) United States Patent
Runyon et al.

(10) Patent No.: US 9,065,162 B2
(45) Date of Patent: Jun. 23, 2015

(54) IN-PHASE H-PLANE WAVEGUIDE T-JUNCTION WITH E-PLANE SEPTUM

(71) Applicant: ViaSat, Inc., Carlsbad, CA (US)

(72) Inventors: Donald Lawson Runyon, Duluth, GA (US); Dominic Quang Nguyen, Duluth, GA (US); Anders Jensen, Johns Creek, GA (US)

(73) Assignee: VIASAT, INC., Carlsbad, CA (US)

( * ) Notice: Subject to any disclaimer, the term of this patent is extended or adjusted under 35 U.S.C. 154(b) by 153 days.

(21) Appl. No.: 13/707,049

(22) Filed: Dec. 6, 2012

(65) Prior Publication Data

US 2013/0154764 A1 Jun. 20, 2013

Related U.S. Application Data

(60) Provisional application No. 61/567,586, filed on Dec. 6, 2011.

(51) Int. Cl.

| | |
|---|---|
| ***H01P 5/12*** | (2006.01) |
| ***H01P 11/00*** | (2006.01) |
| ***H01Q 1/02*** | (2006.01) |

(Continued)

(52) U.S. Cl.

CPC ..... *H01P 5/12* (2013.01); *H01P 11/001* (2013.01); *Y10T 29/49016* (2015.01); *Y10T 29/49002* (2015.01); *H01Q 1/02* (2013.01); *H01P 11/00* (2013.01); *H01Q 13/0233* (2013.01); *H01Q 21/0037* (2013.01)

(58) Field of Classification Search

CPC ..... H01P 5/12; H01P 11/001; H01P 11/00

USPC ..... 333/126, 135, 137, 239, 249, 21 A, 125

See application file for complete search history.

(56) References Cited

U.S. PATENT DOCUMENTS

| | | | | |
|---|---|---|---|---|
| 4,467,294 | A * | 8/1984 | Janky et al. | 333/126 |
| 4,743,915 | A | 5/1988 | Rammos et al. | |

(Continued)

FOREIGN PATENT DOCUMENTS

| | | | |
|---|---|---|---|
| WO | 02/09227 | A1 | 1/2002 |
| WO | 2006/061865 | A1 | 6/2006 |

(Continued)

OTHER PUBLICATIONS

Dittloff et al., Computer Aided Design of Optimum E- or H-Plane N-Furcated Waveguide Power Dividers, 17th European Microwave Conference, Sep. 7, 1987 to Sep. 11, 1987, pp. 181-186.

(Continued)

*Primary Examiner* — Benny Lee
*Assistant Examiner* — Rakesh Patel

(57) ABSTRACT

In an example embodiment, an in-phase H-plane T-junction can comprise: a first waveguide port; a second waveguide port; a third waveguide port, wherein the third waveguide port can be a common port; and an E-plane septum. The first, second, and third waveguide ports can be in the H-plane and can be each connected to each other in a T configuration. The T-junction can be configured such that microwave signals in a first band can be in-phase with each other at the first and second waveguide ports, and microwave signals in a second band can be in-phase with each other at the first and second waveguide ports. The H-plane T-junction can be at least one of a power combiner and a power divider.

19 Claims, 28 Drawing Sheets

(51) Int. Cl.
*H01Q 13/02* (2006.01)
*H01Q 21/00* (2006.01)

(56) References Cited

U.S. PATENT DOCUMENTS

| | | | | |
|---|---|---|---|---|
| 5,079,527 | A | 1/1992 | Goldfarb | |
| 5,243,357 | A | 9/1993 | Koike et al. | |
| 5,291,650 | A | 3/1994 | Carvalho et al. | |
| 5,473,294 | A | 12/1995 | Mizzoni et al. | |
| 5,568,160 | A | 10/1996 | Collins | |
| 5,736,908 | A * | 4/1998 | Alexanian et al. | 333/125 |
| 6,034,647 | A | 3/2000 | Paul et al. | |
| 6,118,353 | A | 9/2000 | McKay | |
| 6,201,508 | B1 | 3/2001 | Metzen et al. | |
| 6,411,174 | B1 | 6/2002 | Crouch et al. | |
| 6,563,398 | B1 | 5/2003 | Wu | |
| 7,927,402 | B1 | 4/2011 | Grzeslak et al. | |
| 2004/0178863 | A1 | 9/2004 | Chan et al. | |
| 2006/0226931 | A1 | 10/2006 | Tavassoli Hozouri | |
| 2007/0182507 | A1 | 8/2007 | Chang et al. | |
| 2011/0061539 | A1 | 3/2011 | Lam et al. | |
| 2011/0153283 | A1 * | 6/2011 | Kohara et al. | 703/1 |
| 2011/0156838 | A1 | 6/2011 | Huang et al. | |
| 2011/0267250 | A1 | 11/2011 | Seifried et al. | |
| 2012/0218160 | A1 | 8/2012 | Montgomery et al. | |
| 2013/0141186 | A1 | 6/2013 | Nguyen et al. | |

FOREIGN PATENT DOCUMENTS

| | | | |
|---|---|---|---|
| WO | 2008/069369 | A1 | 6/2008 |
| WO | WO 2008/147132 | A1 | 12/2008 |

OTHER PUBLICATIONS

Goldfarb, A Recombinant, In-Phase Power Divider, IEEE Transactions on Microwave Theory and Techniques, vol. 39, No. 8, Aug. 1991, pp. 1438-1440.
Rebollar et al., Design of a Compact KA-Band Three-Way Power Divider, IEEE, 1994, 0-7803-2009-3/94, pp. 1074-1077.
Sehm et al., A Large Planar Antenna Consisting of an Array of Waveguide FED Horns, 26th EuMC, Sep. 9, 1996 to Sep. 12, 1996, Prague, Czech Republic, pp. 610-613.
Christopher et al., Design Aspects of Compact High Power Multiport Unequal Power Dividers, IEEE, 1996, 0/7803-3232-6/96, pp. 63-67.
Dudko et al., A Wide Band Matching of H-Plane Tee, MMET '96 Proceedings, Lviv, Ukraine, VIth Int'l. Conf. on Mathematical Methods in Electromagnetic Theory, 1996, pp. 309-312.
Joubert et al., Design of Unequal H-Plane Waveguide Power Dividers for Array Applications, IEEE, 1996, 0-7803-3216-4/96, pp. 1639-1639.
Wollack, On the Compensation of E-Plane Bifrucations in Rectangular Waveguide, NRAO, Charlottesville, VA, Oct. 20, 1997.
Gardner et al., Mode Matching Design of Three-Way Waveguide Power Dividers, The Institute of Electrical Engineers, 1997, London, UK, 4 pgs.
Sehm et al., A Large Planar 39-GHZ Antenna Array of Waveguide-FED Horns, IEEE Transactions on Antennas and Propagation, vol. 46, No. 8, Aug. 1998, pp. 1189-1193.
Soroka et al., Simulation of Multichannel Waveguide Power Dividers, MSMW '98 Symposium Proceedings, Kharkov, Ukraine, Sep. 15, 1998 to Sep. 17, 1998, pp. 634-635.
Sehm et al., A 38 GHz Horn Antenna Array, 28th European Microwave Conference Amsterdam 1998, pp. 184-189.
Hersey et al., Self Regenerating Desiccant for Water Management in External Aircraft Electronics, IEEE, Aerospace Conference, Mar. 6, 1999 to Mar. 13, 1999, pp. 183-191.
Sehm et al., A High-Gain 58-GHz Box-Horn Array Antenna With Suppressed Grating Lobes, IEEE Transactions on Antennas and Propagation, vol. 47, No. 7, Jul. 1999, pp. 1125-1130.
Sehm et al., A 64-Element Array Antenna for 58 GHz, IEEE, 1999, 0-7803-5639-X/99, pp. 2744-2747.
Kerr, Alma MEMO 381—Elements for E-Plane Split-Block Waveguide Circuits, http://www.mma.nrao.edu/memos/, Jul. 5, 2001.
Bozzi et al., A Compact, Wideband, Phase-Equalized Waveguide Divider/Combiner for Power Amplification, 33rd European Microwave Conference, Munich, 2003, pp. 155-158.
Yang et al., Synthesis of a Compound T-Junction for a Two-Way Splitter With Arbitrary Power Ratio, IEEE, 2005, 0-7803-8846-1/05, pp. 985-988.
Panda et al., Multiple Cavity Modeling of a Feed Network for Two Dimensional Phased Array Application, Progress in Electromagnetics Research Letters, vol. 2, 2008, pp. 135-140.
Mestezky et al., Unequal, Equi-Phase, 1:N Power Divider Based on a Sectoral Waveguide, Int'l. Journal of Microwave and Optical Technology, vol. 4, No. 3, May 2009, pp. 170-174.
Kim et al., Design of High Power Split Waveguide Array in W-Band, IEEE, 2009, 978-1-4244-5417-4/09, 2 pgs.
Chen et al., An Ultra Wide Band Power Divider/Combiner Based on Y-Structure Waveguide, IEEE, ICMMT 2010 Proceedings, 2010, 978-1-4244-5708-3/10, pp. 853-855.
Wu et al., "Analytical Design Method of Multiway Dual-Band Planar Power Dividers With Arbitrary Power Division", IEEE Transactions on Microwave Theory and Techniques, vol. 58, Issue: 12, Dec. 10, 2010, pp. 3832-3841.
Non-Final Office Action mailed in U.S. Appl. No. 13/707,352 on Oct. 28, 2014, 12 pgs.
Non-Final Office Action mailed in U.S. Appl. No. 13/707,352 on Apr. 2, 2015, 9 pgs.

* cited by examiner

IN-PHASE H-PLANE WAVEGUIDE T-JUNCTION WITH E-PLANE SEPTUM

CROSS-REFERENCE TO RELATED APPLICATIONS

This application claims priority to U.S. Provisional Application No. 61/567,586, entitled "Mobile Antenna," which was filed on Dec. 6, 2011, the contents of which are hereby incorporated by reference for any purpose in their entirety.

FIELD OF INVENTION

The present disclosure relates generally to radio frequency (RF) antenna devices, and specifically in-phase H-plane waveguide T-junctions.

BACKGROUND

Horn type RF antenna devices typically comprise waveguide power dividers/combiners to divide/combine signals between a common port and an array of horn elements. As the number of feed horns in an antenna array increases, the waveguide power divider/combiner structure becomes increasingly complex and space consuming. Furthermore, operational frequency bandwidths tend to be increasing over time, causing a desire for power divider/combiner structures that can offer high performance over bandwidths approaching the theoretical limits of single mode operation. This can be problematic in many environments where space and/or weight are at a premium. Moreover, efforts thus far to create wider bandwidth, more compact, lighter waveguide power divider/combiner structures have often times resulted in systems that have undesirable performance results.

A prior art waveguide splitter is the magic tee. The magic tee is somewhat bulky and typically involves termination of the delta port.

New devices for improving waveguide power divider/combiner structures are now described.

SUMMARY

In an example embodiment, an in-phase H-plane T-junction can comprise: a first waveguide port; a second waveguide port; a third waveguide port, wherein the third waveguide port can be a common port; and an E-plane septum. The first, second, and third waveguide ports can be in the H-plane and can be each connected to each other in a T configuration. The T-junction can be configured such that microwave signals in a first hand can be in-phase with each other at the first and second waveguide ports, and microwave signals in a second hand can be in-phase with each other at the first and second waveguide ports. The H-plane T-junction can be at least one of a power combiner and a power divider.

In another example embodiment, an in-phase H-plane T-junction can comprise: a first waveguide having a first waveguide port at a first end of said first waveguide and an H-type T-junction with an E-plane septum at a second end of the first waveguide. The E-plane septum can be a full width E-plane septum across the width of the first waveguide and divides the first waveguide into a top waveguide portion and a bottom waveguide portion. The output of the first waveguide port faces in a first direction. The first waveguide port can be in a first plane. A second waveguide port can be configured so that its output faces in a second direction. The second waveguide port can be in a second plane. The second waveguide port can be connected to a second waveguide that can be connected to the bottom waveguide portion. A third waveguide port can be configured so that its output faces in a third direction opposite the second direction. The third waveguide port can be in a third plane. The first, second and third planes can be parallel to each other. The third waveguide port can be connected to a third waveguide that connects to the top waveguide portion. The T-junction can be configured such that microwave signals in a first band can be in-phase with each other at the second and third waveguide ports, and microwave signals in a second hand can in-phase with each other at the second and third waveguide ports. The H-plane T-junction can be at least one of a power combiner and a power divider.

A method is provided for making an in-phase H-plane T-junction, wherein the T-junction comprises one of a power combiner and a power divider. The method can comprise the operations of forming a T-junction waveguide by removing material from both sides of a metal substrate to form first, second, and third waveguides. The third waveguide can have a common port at one end. The first and second waveguides can comprise first and second ports oriented in opposite and collinear directions. The method can further comprise forming an E-plane septum in the third waveguide. The E-plane septum can be a full width E-plane septum across the width of the third waveguide and divides the third waveguide into a top wave guide portion and a bottom waveguide portion. The method can further comprise attaching a first cover over a first side of the metal substrate and attaching a second cover over a second side of the metal substrate to enclose portions of the first, second and third waveguides.

BRIEF DESCRIPTION OF THE DRAWING FIGURES

Additional aspects of the present invention will become evident upon reviewing the non-limiting embodiments described in the specification and the claims taken in conjunction with the accompanying figures, wherein like numerals designate like elements, and:

DETAILED DESCRIPTION

Figure 1:
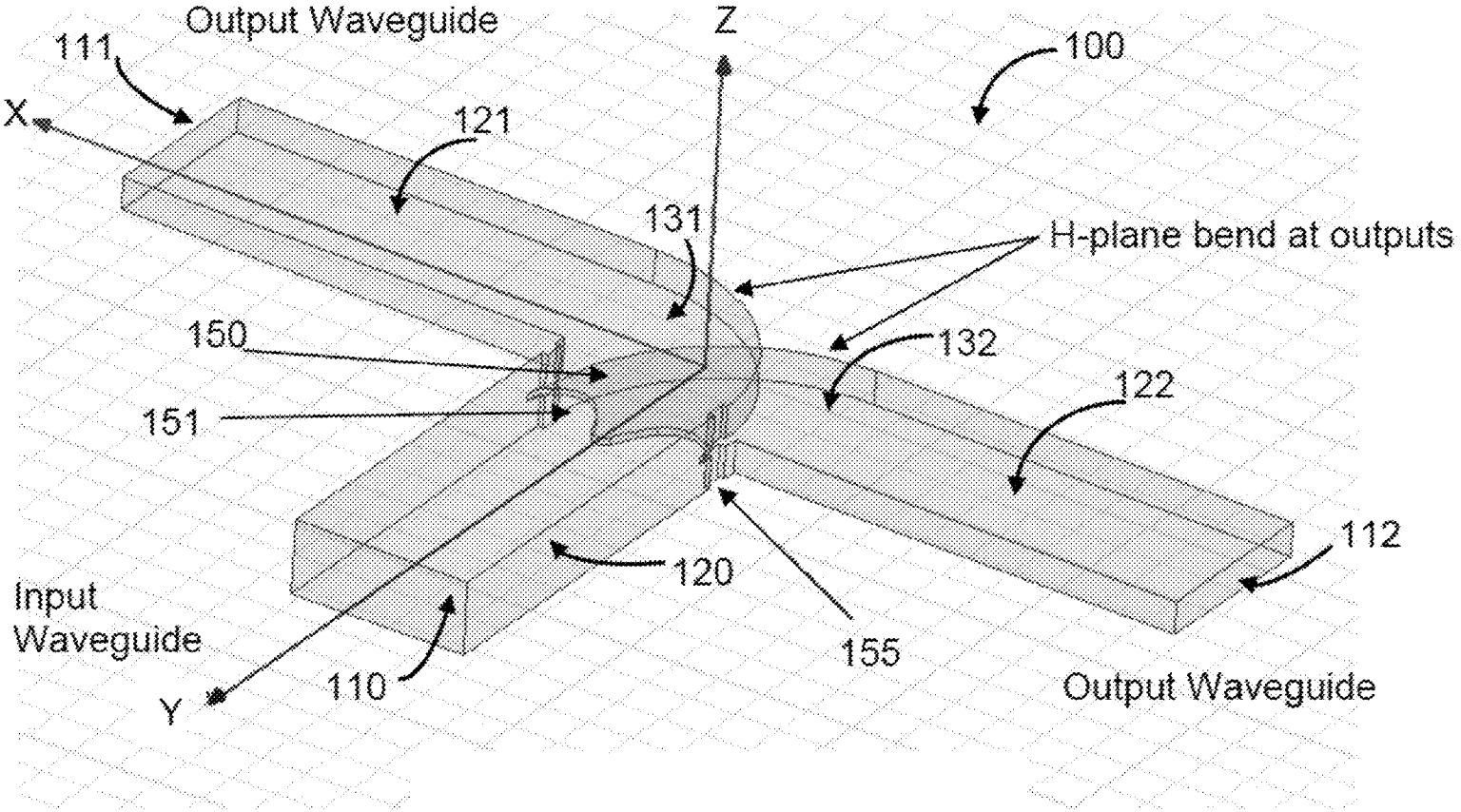
FIG. 1 is a perspective view of an example H-plane T-junction with an E-plane septum.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

In accordance with one example embodiment, an in-phase H-plane T-junction can comprise an E-plane septum. In accordance with a second example embodiment, an in-phase H-plane T-junction can comprise an offset asymmetric septum shaped with a non-linear shape on a first side of the offset asymmetric septum. In each of these two example embodiments, the H-plane T-junction can be at least one of a power combiner and a power divider.

Figure 17:
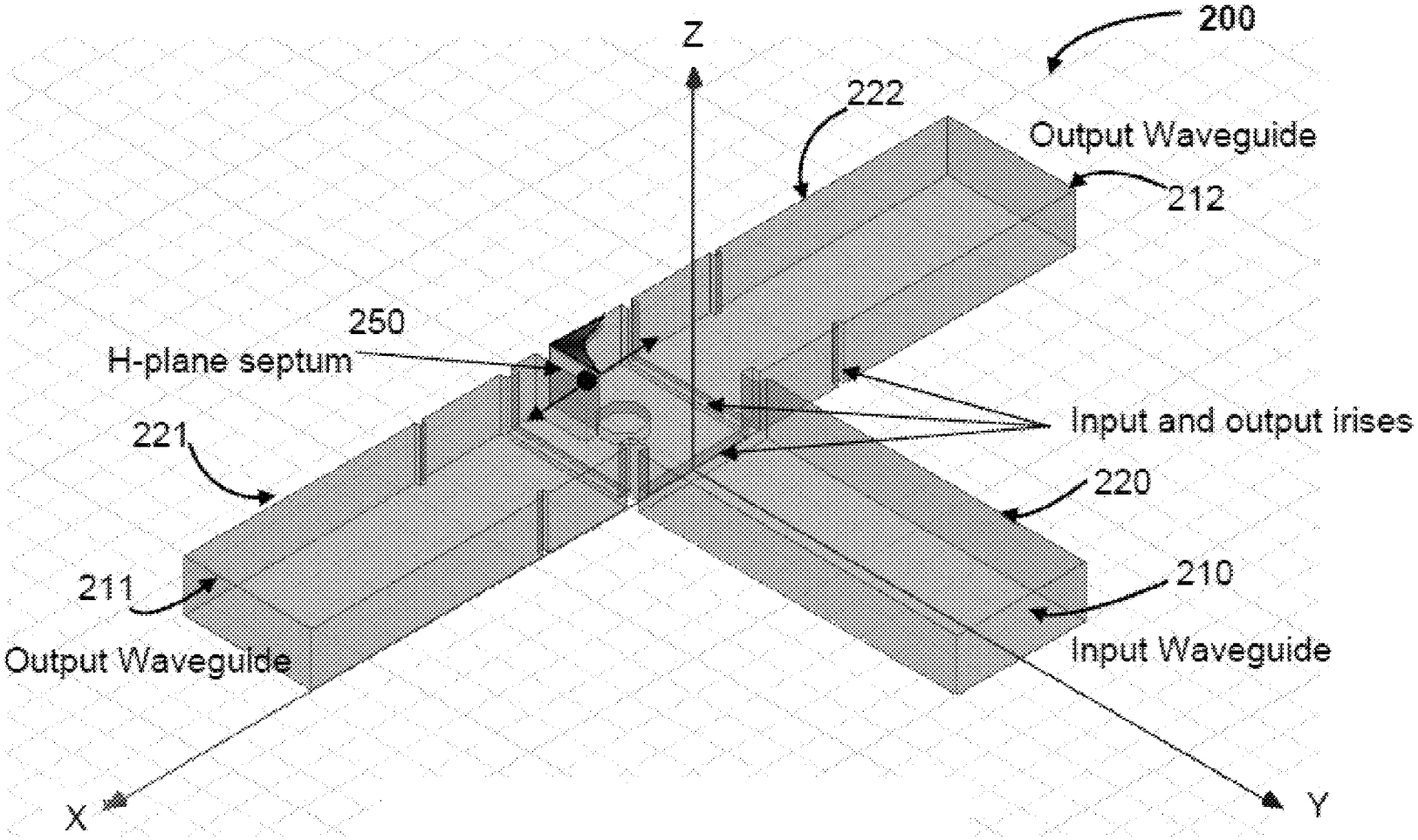
FIG. 17 is a perspective view of an example H-plane T-junction with an H-plane septum.

With reference to FIG. 1 and FIG. 17, in an example embodiment, an H-plane T-junction (100, 200) can be a waveguide structure. The H-plane T-junction (100, 200) can comprise a first waveguide port (111, 211), a second waveguide port (112, 212), and a third waveguide port (110, 210). Thus, the H-plane T-junction can comprise a three port device. In an example embodiment, the H-plane T-junction is not a magic tee. The H-plane T-junction can be a waveguide power divider. The H-plane T-junction can be a waveguide power combiner. In an example embodiment, the H-plane T-junction can be both a waveguide power divider and a waveguide power combiner. For example, the H-plane junction can be used in an RF antenna transceiver for simultaneously sending and receiving RF signals. Stated another way, the waveguide H-plane T-junction (100, 200) can be a waveguide T-junction in which the change in structure occurs in the plane of the magnetic field, similar to a shunt T-junction. The change in structure can be the transition from the waveguide channel corresponding to the third port (110, 210) to the waveguide channels corresponding to the first (111, 211) and second ports (112, 212).

For convenience in describing H-plane T-junction (100, 200), it may at times be described only from the perspective of a waveguide power divider. As such, the waveguide power divider can comprise a single input port (110, 210) and two output ports (111, 112 and 211, 212, respectively). It should be understood, however, that the description of H-plane T-junction (100, 200) may also cover a waveguide power combiner where the same two ports (111, 112 and 211, 212, respectively) can be input ports, and the single port (110, 210) can be an output port. For simplicity, the single port (110, 210) may be referred to herein as a common port. Common port (110, 210) can be the input port in a waveguide power divider and an output port in a waveguide power combiner.

With reference again to FIGS. 1 and 17, a Cartesian coordinate system can be useful for describing the relative relationships and orientations of the waveguides, the ports, and the other components of the H-plane T-junction. The coordinate system can comprise an X axis, a Y axis, and a Z axis, wherein each axis is perpendicular to the other two axes, H-plane T-junction (100, 200) can comprise a first elongate rectangular waveguide (121, 221), a second elongate rectangular waveguide (122, 222), and a third elongate rectangular waveguide (120, 220). These waveguides can each be located in a plane(s) that can be parallel to a plane containing the X and Y axis. The first waveguide can have a longitudinal axis along the positive X axis, the second waveguide can have a longitudinal axis along the negative X axis, and the third waveguide can have a longitudinal axis along the Y axis. The waveguides can each have a width in the X-Y plane, and a height in the Z direction.

Moreover, the H-plane T-junction can comprise a first port, or output port (111, 211), a second port or output port (112, 212), and a third waveguide port, input port, or common port (110, 210). First port (111, 211) can be oriented perpendicular to and facing outward in the direction of the positive X axis. Second port (112, 212) can be oriented perpendicular to and facing outward in the direction of the negative X axis. Common port (110, 210) can be oriented perpendicular to and facing outward in the direction of the Y axis. The first, second, and third waveguides can be connected to each other in a T configuration. That is, the waveguides that form the H-plane T-junction can comprise a T shaped device.

With particular reference to FIG. 17, the T shaped device can be entirely in one plane—a plane having a thickness of the height of the waveguides. In an example embodiment, the waveguides that form the H-plane T-junction can be all in the same plane. In particular, the waveguides that form the H-plane T-Junction can be all in the H-plane. In an example embodiment, the waveguide H-plane T-junction can have the major waveguide channel structures configured in the plane of the magnetic field.

Figure 2:
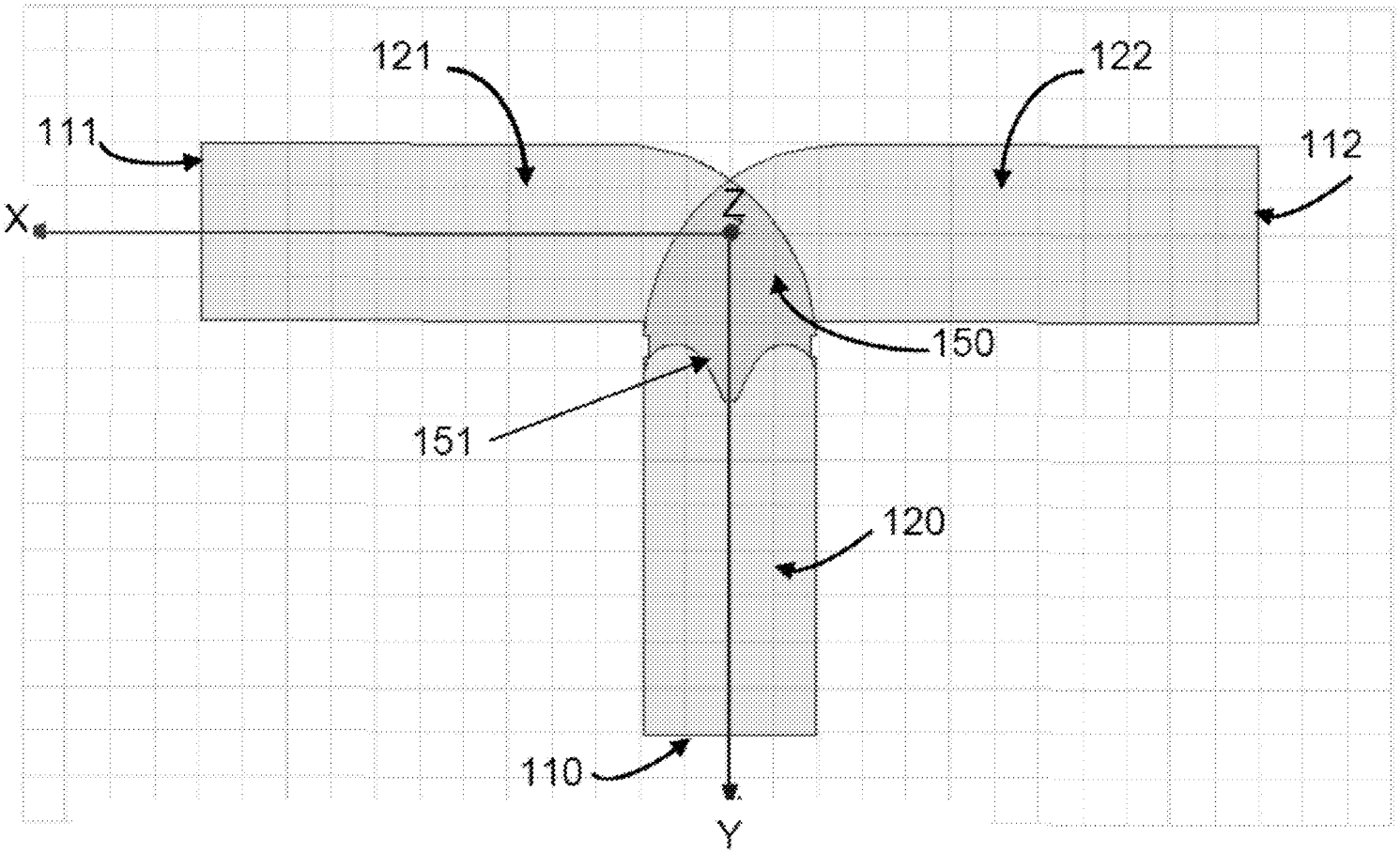
FIG. 2 is top view of an example H-plane T-junction with an E-plane septum.
Figure 3:
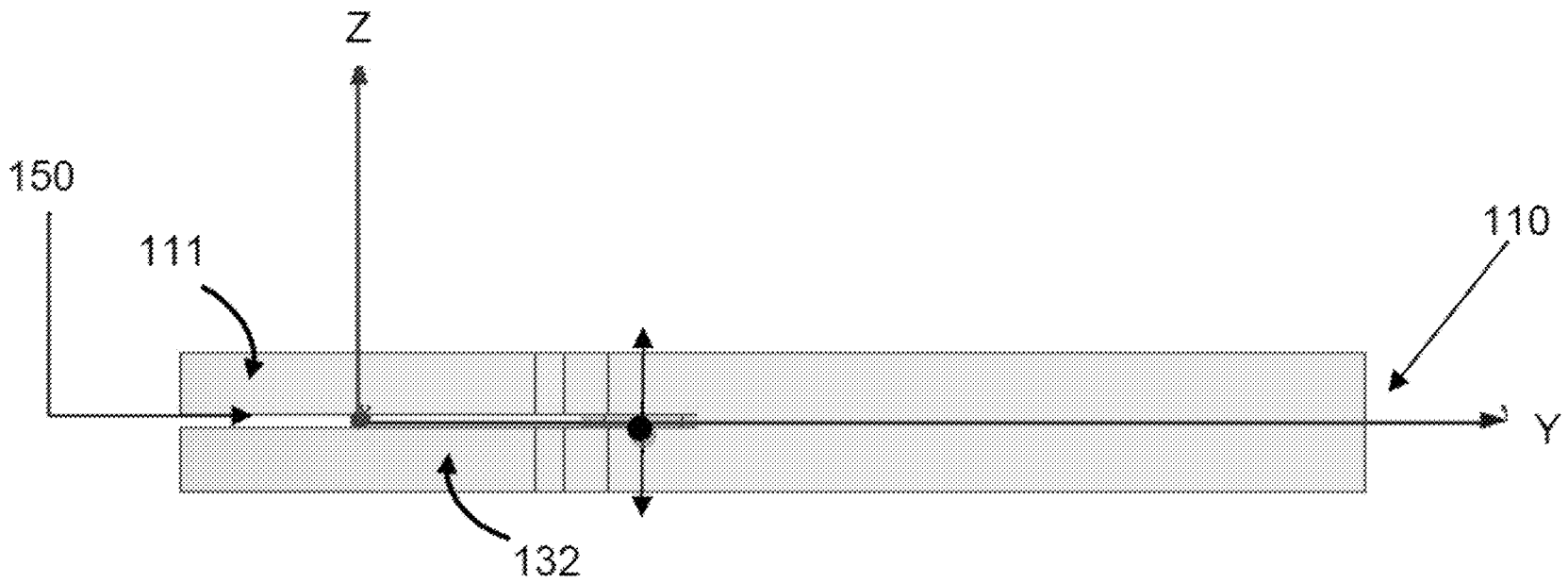
FIG. 3 is side view of an example H-plane T-junction with an septum.

With particular reference to FIG. 1, in an example embodiment, the T shaped device can be entirely within planes parallel to the X-Y plane. In other words, at least a portion of first waveguide (121) can be in a different plane from a portion of second waveguide (122), but both in planes that can be parallel to each other. And portions of third waveguide (12) can comprise a plane(s) parallel to and/or overlapping with the planes of the first and second waveguides. FIG. 2 is top view of an example H-plane T-junction with an E-plane septum. FIG. 3 is side view of an example H-plane T-junction with an E-plane septum.

In an example embodiment, H-plane T-junction (100, 200) can be configured such that microwave signals in a first hand are in-phase with each other at the first and second waveguide ports (111, 112 for FIG. 1 and 211, 212, for FIG. 17 respectively). In an example embodiment, H-plane T-junction (100, 200) can be configured such that microwave signals in a second band are in-phase with each other at the first and second waveguide ports (111, 112 for FIG. 1 and 211, 212, for FIG. 17 respectively). Thusly, the H-plane T-junction can be "in-phase." In an example embodiment, the microwave signals of the first band can be in phase with each other at the first and second waveguide ports and at the same time the microwave signals of the second band can be in phase with each other at the first and second waveguide ports. In an example embodiment, the in-phase condition can be maintained over a wide frequency band and can be achieved over RF bandwidths exceeding a ratio of 1.5:1. Stated another way, the in-phase power combiner/divider can be a 0°/0° power combiner/divider. H-plane T-junction can be a reactive combiner/divider without a fourth port that may be terminated for out-of-phase energy components.

Each of the first, second and third waveguide ports can be configured for receiving or providing an RF signal to a connected waveguide. It should be noted that generally, the H-plane T-junction can be integrally formed with "connected" waveguides, such that the H-plane T-junction inputs/outputs can be located at any suitable point away from the junction of the three waveguides that form the T shaped structure. Furthermore, the "connected" waveguides can bend, turn, step up or down, and/or shift to other planes or orientations. By way of example, and with reference to FIG. 18, the H-plane T-junction can have an H-plane bend at the T-junction common waveguide just before the junction. As another example, and with reference to FIG. 23, the H-plane T-junction can have an E-plane jog at the T-junction input in the common waveguide. In both of these examples, the H-plane T-junction still has H-plane waveguides and ports and it can still considered to be configured in a T-junction. In an example embodiment, the in-plane T-junction section output or input can be routed via waveguide channels to locations or interfaces that may be in-plane or out of plane. Thus, the description of example H-plane T-junctions herein has specific application to the region immediately proximate to the junction of the T shaped structure.

In accordance with various aspects, the first band can be a receive frequency band. In an example embodiment, H-plane T-junction (100, 200) can be configured to receive a first receive signal at first waveguide port (111, 211) and a second receive signal at second waveguide port (112, 212). In an example embodiment, H-plane T-junction (100, 200) can be configured such that the first receive signal can be in-phase with the second receive signal. In an example embodiment, the receive frequency band can be from 17.7 to 21.2.0 GHz, from 17.7 to 20.2 GHz, or from 18.3 to 20.2 GHz. Moreover, the receive frequency band can be any suitable frequency band.

In an example embodiment, the waveguide can be sized for dominant mode signal transmission where the width and height of the waveguide can have a dimension (width "a" and height "b") where "a" is greater than $\lambda_L/2$ and less than $\lambda_H$ where $\lambda_L$ is the free-space wavelength at the lowest operational frequency and $\lambda_H$ is the free-space wavelength at the highest operational frequency. Waveguide height "b" can be selected to be less than "a" to avoid a degenerate or higher order mode of signal transmission. In an example embodiment, the lower frequency limit can establish a lower limit to the waveguide size as it is the "waveguide cutoff" where signal transmission effectively ceases. In practical applications it can be desirable for the waveguide size to be selected to avoid operation less than 8% above the cutoff value ($\lambda_L$>1.08a/2), because, for example, the loss can increase as the cutoff value ($\lambda$=a/2) is approached. In applications where there is significant length of waveguide involved in the power distribution network, the lower limit can be constrained to be 12% above the cutoff value ($\lambda_L$>1.12a/2). In an example embodiment, the higher frequency limit ($\lambda_H$/a) can restricts higher order mode transmission that can be deleterious to the objective signal transmission performance. Practically it can be useful to define a margin below the limit and this margin is tied to the achievable manufacturing tolerances. For precision manufacturing a limit can be defined that is 2% below the theoretical value ($\lambda_H$<0.98a). Thus, as a practical limit, the rectangular waveguide can be configured, in an example embodiment, to operate over a band or set of bands that have a ratio of the highest frequency to the lowest frequency of (2*0.98/1.08=) 1.815 and typically no more than (2*0.98/1.12=) 1.75 for applications involving significant lengths of waveguide and precision manufacturing technology. Conventional or standard waveguide bands are defined with ratios of 1.5 (e.g., encompassing 12-18 GHz).

In accordance with various aspects, the second hand can be a transmit frequency band. In an example embodiment, H-plane T-junction (100, 200) can be configured to transmit a first transmit signal from first waveguide port (111, 211) and a second transmit signal from second waveguide port (112, 212). In an example embodiment, H-plane T-junction (100, 200) can be configured such that the first transmit signal can be in-phase with the second transmit signal. In an example embodiment, the transmit frequency band can be from 27.5 to 31.0 GHz, from 27.5 to 30.0 GHz, or from 28.1 to 30.0 GHz. Moreover, the transmit frequency band can be any suitable frequency band.

In an example embodiment where the H-plane T-junction is operated in a transceiver manner, the difference in frequency between the receive frequency band and the transmit frequency band can be greater than approximately 1.5. In an example embodiment an H-plane T-junction comprises H-plane waveguides at the three input/output ports. An H-plane waveguide can be a rectangular waveguide with a waveguide width that is wider than the waveguide height. With reference to FIGS. 1 and 17, the waveguides illustrated can each be wider (i.e., in the X or Y directions) than they are tall (i.e., in the Z direction). In an example embodiment, the waveguide common port and the waveguide output ports can be of similar or equal width. This facilitates use across a broad band of frequencies. However, in other example embodiments, the waveguide width of the common port can differ from that of the other two ports.

With reference now to FIG. 1, in an example embodiment, an in-phase H-plane T-junction 100 can comprise an E-plane septum 150. The H-plane T-junction can be at least one of a power combiner and a power divider. In another example embodiment, an in-phase H-plane T-junction can comprise: a first waveguide port; a second waveguide port; a third waveguide port, wherein the third waveguide port is a common port; and an E-plane septum. In this embodiment, the first, second and third waveguide ports can each be in the H plane and can be each connected to each other in a T configuration. Moreover, the T-junction can be configured such that microwave signals in a first band are in-phase with each other at the first and second waveguide ports, and microwave signals in a second band are in-phase with each other at the first and second waveguide ports. Furthermore, the H-plane T-junction can be at least one of a power combiner and a power divider and the in-phase condition can be maintained over a wide frequency band.

In an example embodiment, and with reference again to FIG. 1, the H-plane T-junction 100 comprises a common waveguide 120. The common waveguide 120 can comprise a common waveguide port 110 at a first end of common waveguide 120, and an H-plane type T-junction at a second end of common waveguide 120. The output of the common waveguide port 110 can be in a first direction (e.g., a Y axis direction). The common waveguide port 110 can lie in a first plane (e.g., one parallel to the X-Y plane). Stated another way, the waveguide H-plane T-junction 100 can be a waveguide T-junction in which the change in structure occurs in the plane of the magnetic field, similar to a shunt T-junction. The change in structure can be the transition from the waveguide channel corresponding to the third port 110 to the waveguide channels corresponding to the first 111 and second ports 112. The E-plane septum can be oriented to cause a change in structure in the plane of the electric field at the junction. The septum can be oriented perpendicular to the electric field and parallel to the magnetic field in the waveguide channel. Stated another way, the E-plane septum element can be relatively thin and occur in the plane of the magnetic field.

In an example embodiment, the H-plane T-junction 100 further comprises a first waveguide 121. The first waveguide 121 can comprise a first waveguide port 111 at a first end of first waveguide 121, and an H-plane type T-junction at a second end of first waveguide 121. The output of first waveguide port 111 can be in a second direction (e.g., positive X axis direction). The first waveguide port 111 can lie in a second plane (e.g., one parallel to the X-Y plane).

In an example embodiment, the H-plane T-junction 100 further comprises a second waveguide 122. Second waveguide 122 can comprise a second waveguide port 112 at a first end of second waveguide 122, and an H-plane type T-junction at a second end of second waveguide 122. The output of second waveguide port 112 can be in a third direction (e.g., a negative X axis direction). The second direction can be opposite the third direction and the first direction perpendicular to them both. The second waveguide port can lie in a third plane (e.g., one parallel to the X-Y plane). Thus, each of the common, first and second waveguide ports can lie in planes that are parallel to each other. Stated another way, the first and second waveguides (121, 122) can respectively comprise first and second ports (111, 112) that are oriented in opposite and collinear directions from each other.

In an example embodiment, the H-plane type T-junction can comprise an E-plane septum. The E-plane septum can be connected to the second end of the common, first and second waveguides (120, 121, 122). The E-plane septum can be a full width E-plane septum across the width of the common waveguide 120. Stated another way, the E-plane septum 150 can be formed in the common waveguide 120. The E-plane septum 150 can be configured to divide the second end of common waveguide 120 into a top waveguide portion 131 and a bottom waveguide portion 132. First waveguide 121 can be connected to top waveguide portion 131. Second waveguide 122 can be connected to bottom waveguide portion 132.

E-plane septum 150 can be formed to span from one side wall of common waveguide 120 to the opposite side wall. E-plane septum 150 can be in the same plane as the waveguides (i.e., the X-Y plane). It is noted that above and below the E-plane septum, the top portion and bottom portion can comprise oppositely oriented H-plane bends that can cause the outputs of the H-plane T-junction to be 90 degrees from the input and 180 degrees from each other. In an example embodiment, this H-plane bend can be a smooth curve. In other example embodiments, the H-plane bend can be a mitre type, a multi-step type, a series of compound curves, or a combination of curves and steps.

In an example embodiment, the power split ratio of H-plane T-junction 100 can be the ratio of the cross-sectional area of top waveguide portion 131 over bottom waveguide portion 132. Stated another way, the power split ratio of H-plane T-junction 100 can be proportional to the ratio of the cross-sectional area of the top and bottom portions. In an example embodiment, E-plane septum 150 can be positioned in the Z direction such that an X-Z cross section of the top waveguide portion 131 has an area equal to that of the bottom waveguide portion 132. In this example embodiment, the power split can be an equal power split. In that example embodiment, the area of the common waveguide can be equal to the area of the top waveguide portion plus the bottom waveguide portion plus the area attributable to the septum thickness between the two waveguide portions. Stated another way, the power split can be related to the vertical offset of the E-plane septum within the common waveguide 120. In an example embodiment, the E-plane septum vertical offset can be selected to achieve a desired power split between the first and second waveguides. In another example embodiment, the power split can be an unequal power split. For example, the power split can be 0.5/0.5, 0.33/0.67, 0.25/0.75, or $A/(1-A)$ where $A<1$. Furthermore, any suitable power split can be used. Moreover, in example embodiments, a beamforming network can comprise a plurality of unequal way junctions, where at least one junction can have a different split value from another junction in the network.

Figure 4:
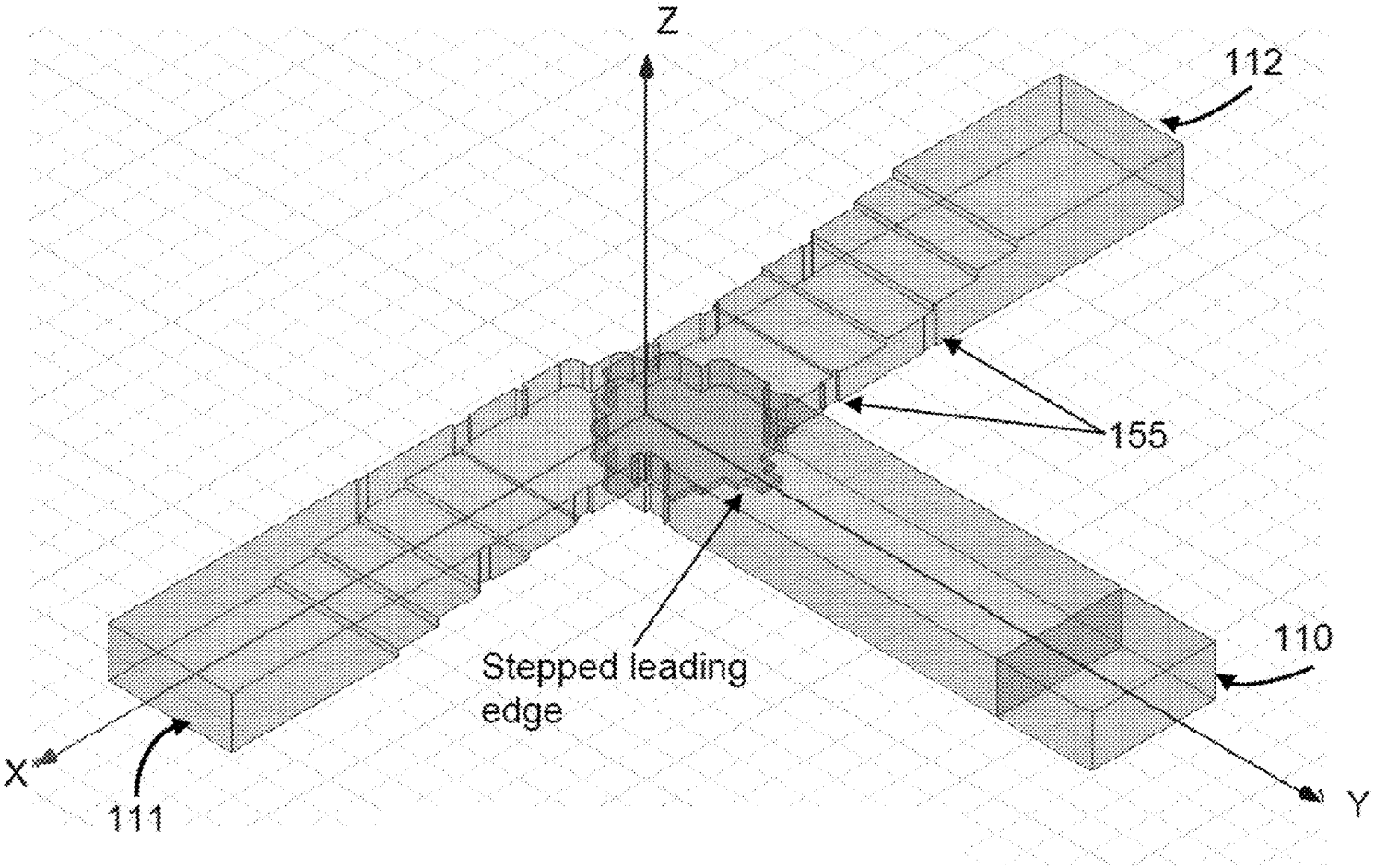
FIG. 4 is a perspective view of an example H-plane T-junction with an E-plane septum and stepped waveguide transitions.

In an example embodiment, E-plane septum 150 comprises a leading edge 151. The leading edge 151 can be shaped. In one example embodiment, and with reference to FIGS. 1, 2, 5, and 9, the leading edge 151 shape can be tapered, in another embodiment, and with reference to FIG. 4, the leading edge shape can be stepped. In another embodiment, the leading edge shape can be a corrugation. In another embodiment, the leading edge shape can be at least one of: tapered, stepped, corrugated, linear tapered, a fillet, a miter, and/or a spline. Moreover, any suitable leading edge shape can be used. In an example embodiment, the leading edge shape can be configured to facilitate matching input impedance and for transitioning the impedance from the common waveguide to the upper and bottom waveguide portions.

With reference again to FIG. 1, H-plane T-junction 100 can be further configured to comprise an iris 155. Iris 155 can comprise a slight narrowed neck on the sidewalls of common waveguide 120. Iris 155 can be located at the input to the H-plane T-junction. For example, iris 155 can be located near the leading edge 151 of E-plane septum 150. In another example embodiment, and with reference to FIG. 4, iris 155 can be located in more than one location and/or in the output waveguides. For example, iris 155 can be located in two places on each of the first and second waveguides. Moreover, irises can be located in any suitable quantity and location on the H-plane T-junction to facilitate matching impedances.

In an example embodiment, both the top 131 and bottom 132 waveguide portions can have a cross sectional area less than that of the cross section area of common waveguide 120. In an example embodiment, the bottom waveguide portion 132 can be configured to transition up such that at second waveguide port 112 second waveguide 122 has a height equal to the height of common waveguide 120. Similarly, top waveguide portion 131 can be configured to transition down such that at first waveguide port 111 first waveguide 121 has a height equal to the height of common waveguide 120. The transition can be a waveguide step transition, a taper transition, a spline transition, or a combination of at least two of the aforementioned shapes. Furthermore, any suitable transition may be used between the top and bottom portions, and the full height of the respective first and second waveguide ports. Thus, the E-plane septum, H-plane T-junction can be configured with the common port, first port and second ports all the same height. In an example embodiment, the common port, first port and second ports can be in the same plane. The transition can be configured to facilitate impedance matching between the H-plane T-junction and the attached waveguide's.

Figure 5:
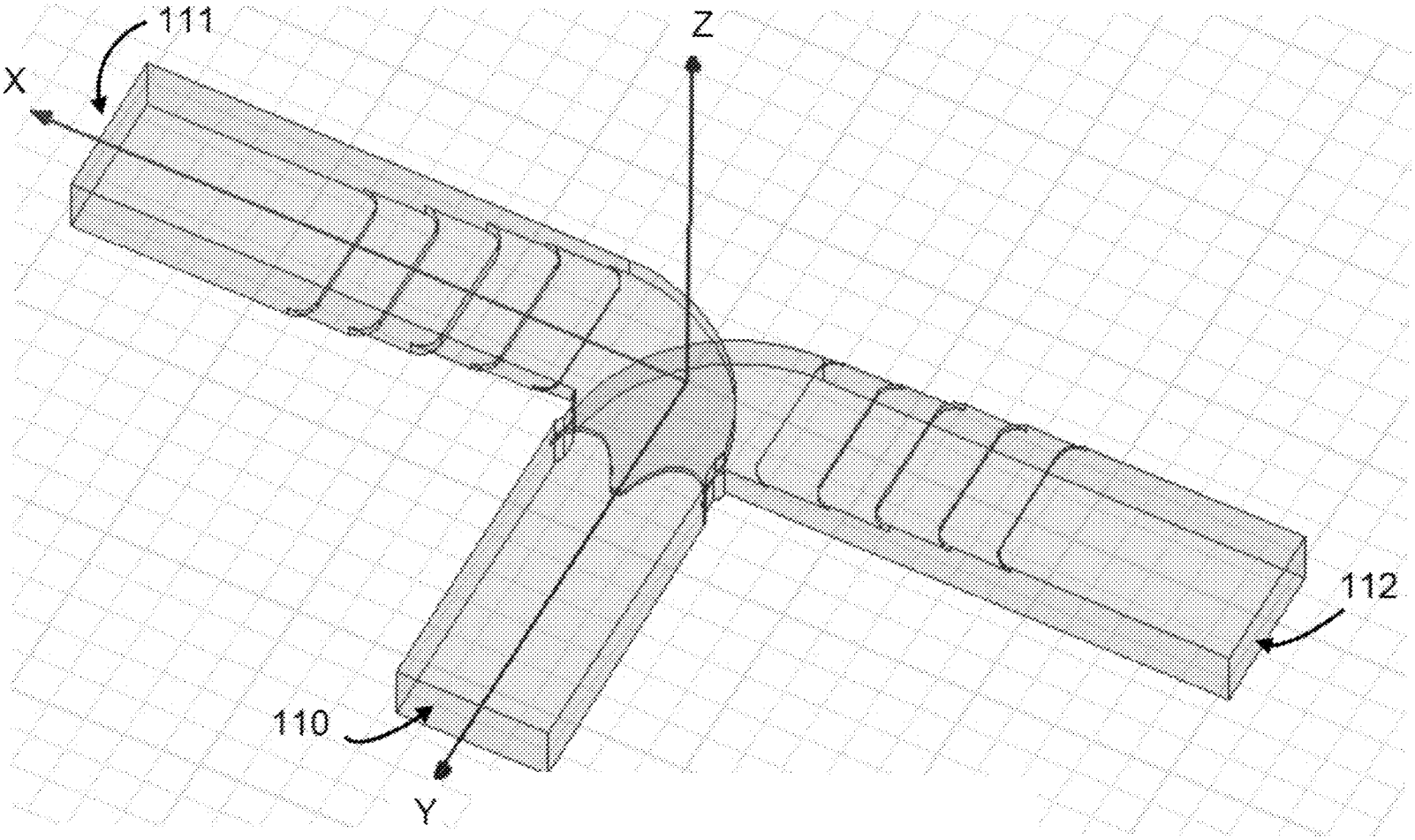
FIG. 5 is a perspective view of another example H-plane T-junction with an E-plane septum, stepped waveguide transitions, and a 2.22 dB split ratio.
Figure 9:
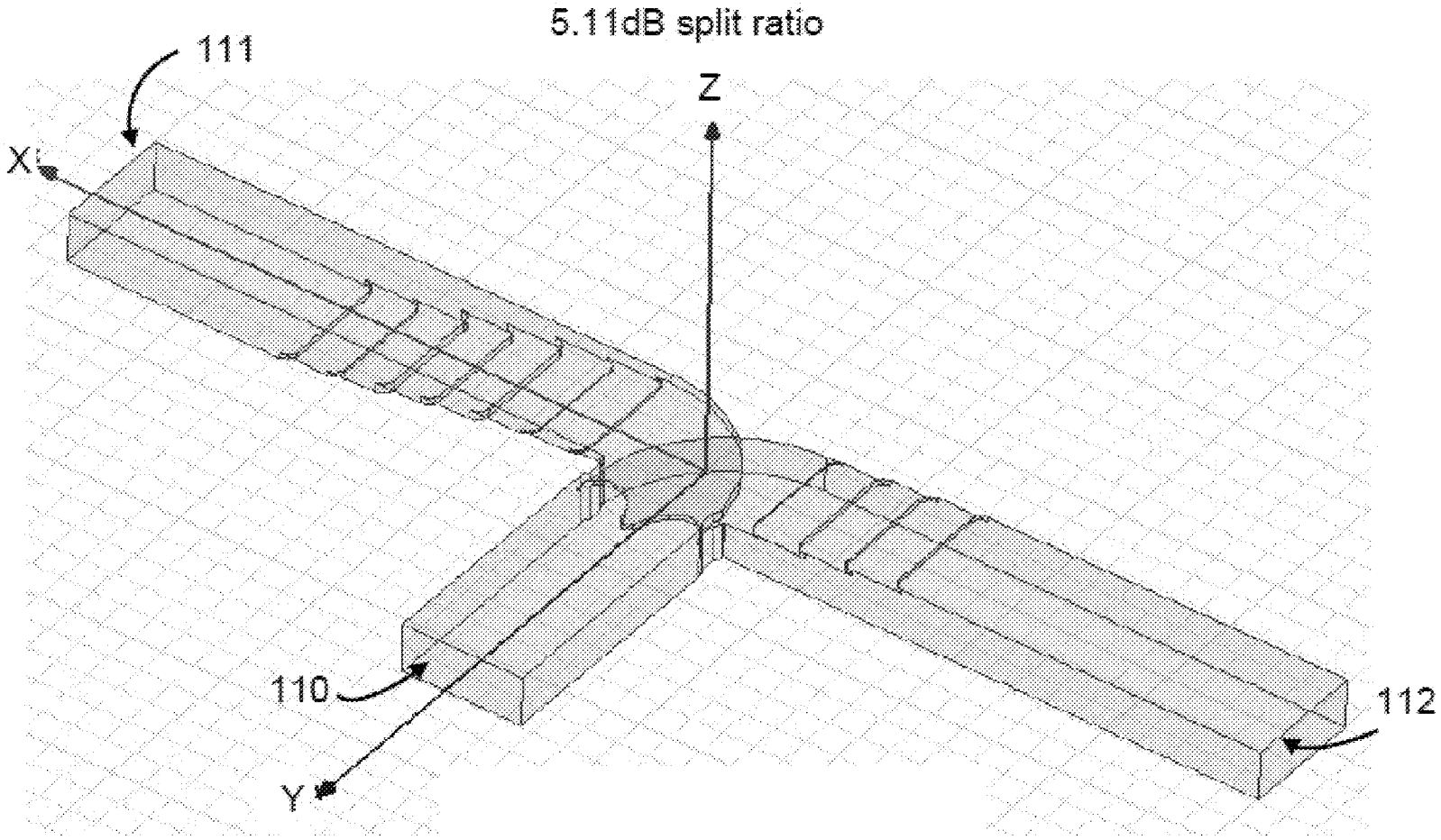
FIG. 9 is a perspective view of another example H-plane T-junction with an E-plane septum, stepped waveguide transitions and a 5.11 dB split ratio.

The E-plane H-plane T-junction may be formed, in one example embodiment, by removing material from both sides of a metal substrate to form the common waveguide, first waveguide, and second waveguide. In locations where the waveguide height is full height, such as near the waveguide ports, the material can be removed completely—creating a complete hole through the metal substrate for those portions of the waveguides. The septum can be formed by removing material from both sides but leaving a thin layer of metal in-between the top and bottom of the metal substrate. For example, and with reference to FIG. 4, in an equal power split embodiment, the E-plane septum can be located approximately half way between the top and the bottom of the metal substrate, so equal amounts of metal can be removed from above and below the remaining septum material. With reference to FIGS. 5, and 9, in an unequal power split embodiment, less material would be removed from one side than the other. Similarly, the amount of material removed from either side can vary in the region transitioning from the E-plane septum back to a full height waveguide. In an example embodiment, the amount of material removed transitions in steps from 50/50 to 0/100 in one of the output branches and 100/0 in the other.

The metal substrate can be made of aluminum, copper, brass, zinc, steel, or other suitable electrically conducting material. The metal substrate can be processed to remove portions of the metal material by using: machining and/or probe EDM. Alternative process for forming the structures can be electroforming, casting, or molding. Furthermore, the substrate can be made of a dielectric or composite dielectric material that can be machined or molded and plated with a conducting layer of thickness of at least approximately three skin depths at the operation frequency band.

After removing the metal material to form the waveguide pathways and E-plane septum, a first cover can be attached over a first side of the metal substrate, and a second cover can be attached over the second side of the metal substrate to enclose portions of the common, first, and second waveguides. The covers can enclose and thus form rectangular waveguide pathways. The covers can comprise aluminum, copper, brass, zinc, steel, and/or any suitable metal material. The covers can be secured using screws or any suitable method of attachment. Furthermore, the cover can be made of a dielectric or composite dielectric material that can be machined, extruded or molded and plated with a conducting layer of thickness of at least approximately three skin depths at the operation frequency band.

In one embodiment, for example, the width of the common and first and second waveguides can be equal to each other. In such embodiments, the H-plane T-junction can be configured to support the relevant frequency bands at each of the ports. In other example embodiments, the widths can be unequal but still configured to propagate signals within the operational frequency band. In an example embodiment, the effective path length of the first and second waveguides 121 and 122 can be equal to each other. The effective path length can be identical for both outputs to preserve equal phase over a wide frequency band.

In an example embodiment, an H-plane T-junction with E-plane septum can be configured to facilitate Ku- and Ka-band satellite communication (SATCOM) applications with advanced antenna aperture distribution functions that comply with regulations, have precise amplitude and phase control, involve simultaneous receive and transmit and dual polarized operation at diverse frequency bands, with a high level of integration to achieve compactness and light weight. In particular the solutions disclosed herein have broader bandwidth capabilities than prior art dividers and combiners. For example, the performance of the H-plane T-junction with E-plane septum can be acceptable over bandwidths as broad as 1.75:1; exceeding the catalog bandwidth (1.5:1) of standard rectangular waveguide tubing.

The H-plane T-junction with E-plane septum can be configured to maintain amplitude and phase equalization across a wide or dual frequency band. It also can have great input match. Some example performance metrics can be illustrated with reference to two example H-plane T-junctions with E-plane septum. The examples are illustrated for dual frequency bands of 18.3 to 20.2 GHz and 28.1 to 30.0 GHz that span an overall bandwidth of (30/18.3) 1.64:1. Although not shown, the H-plane T-junction with E-plane septum performance can be continuous between the band segments and the performance can be maintained throughout the 18.3 to 30.0 GHz range. Relevant performance factors can include: low common (third) port return loss (even at high frequency), power balance between the first and second ports, and phase balance between the first and second ports. Whereas prior art H-plane T-junction may achieve common (third) port return loss values of −14.5 dB (voltage standing wave ratio (VSWR) =1.5) across a bandwidth ratio of 1.5:1, the H-plane T-junction with E-plane septum, in an example embodiment, can be capable of better than −35 dB return loss (VSWR=1.036) on the common port across a bandwidth ratio of 1.64:1. This high degree of performance for individual junctions can be very valuable in beamforming networks comprised of multiple cascaded power combiner/dividers because it can facilitate achieving an overall net performance that can include precise phase and amplitude control that can be consistent over the operational bandwidth. Furthermore, the H-plane T-junction with E-plane septum can be capable of providing this level of performance with an unequal power split and, in an example embodiment, can maintain the power split ratio with precise control over the full bandwidth range. In addition, the H-plane T-junction with E-plane septum can be configured to provide a similar precise control over the phase response with a uniformity unmatched by prior art H-plane T-junction combiner/dividers. In an example embodiment, the excellent common (third) port return loss can facilitate such amplitude and phase responses.

Figure 6:
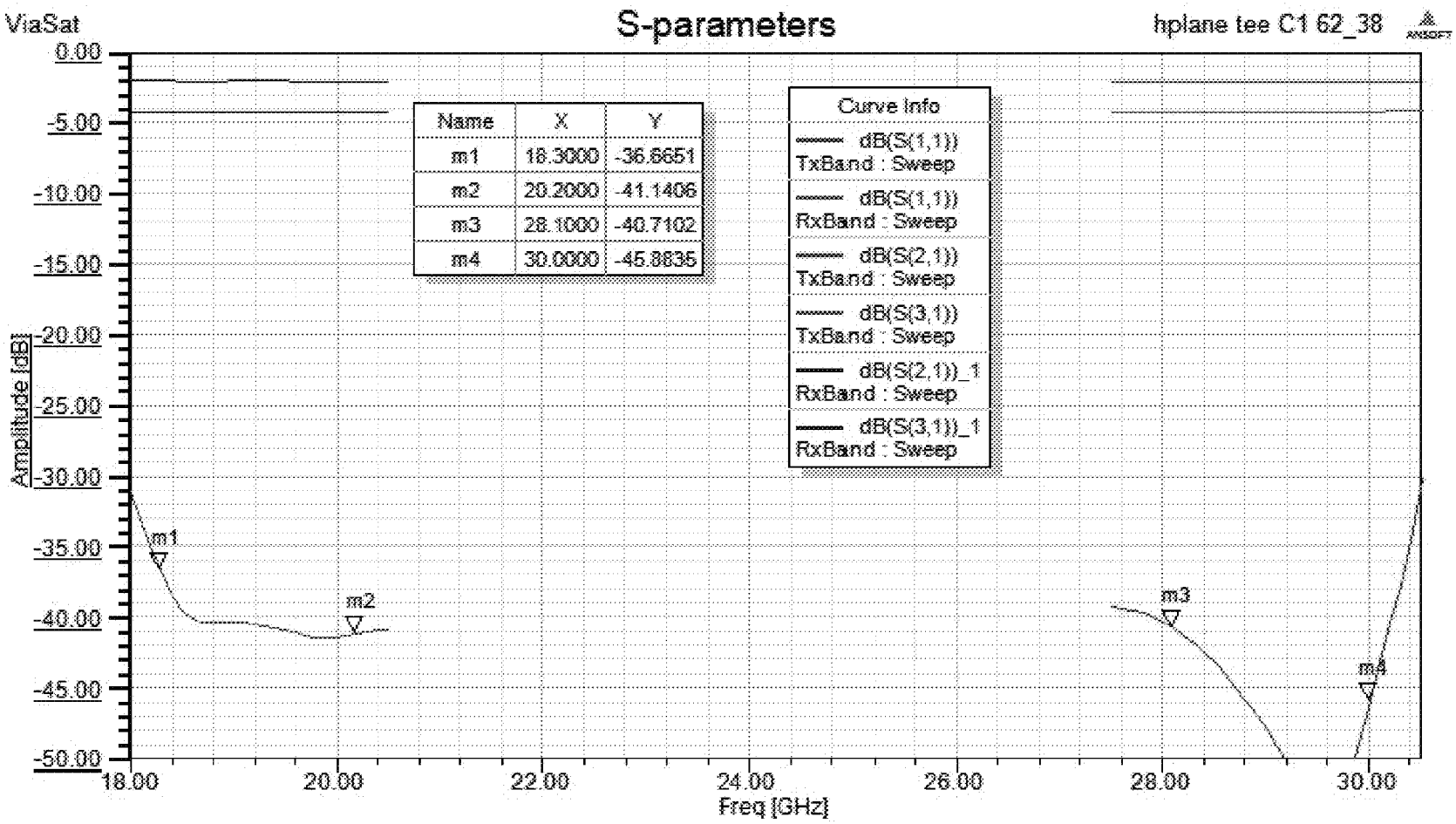
FIGS. 6-8 are graphs showing example performance results for example H-plane T-junctions with an E-plane septum.
Figure 7:
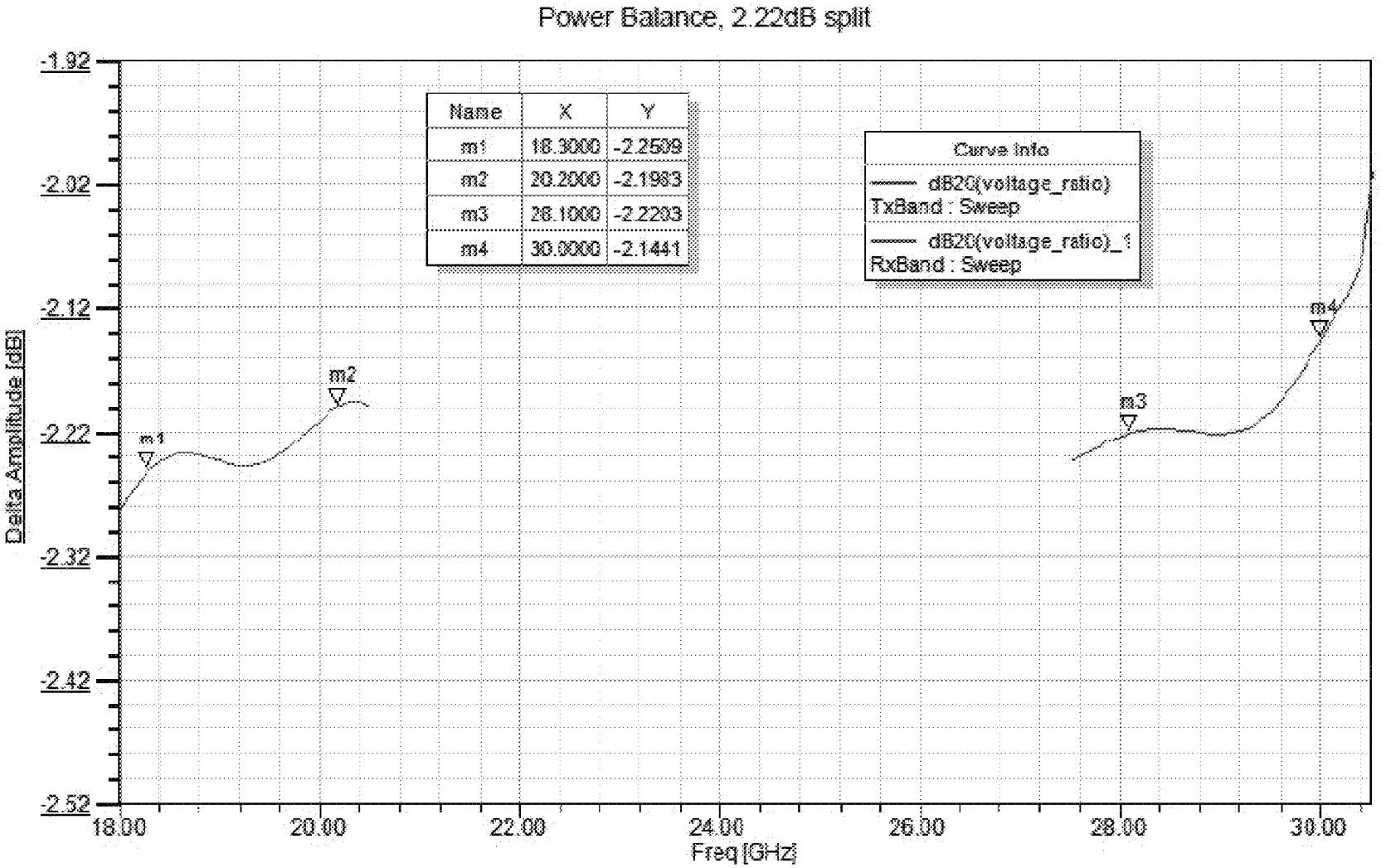
Figure 8:
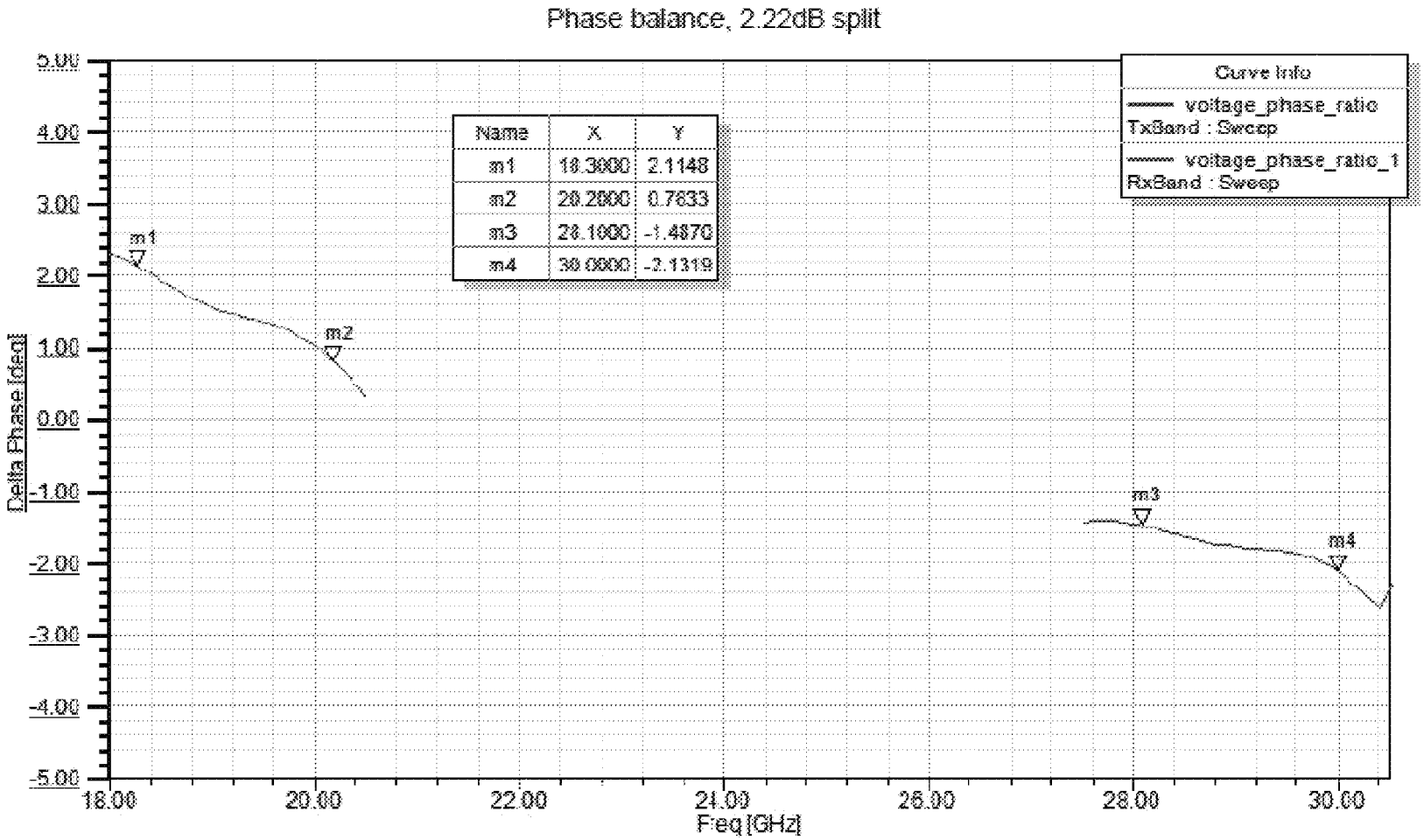
Figure 10:
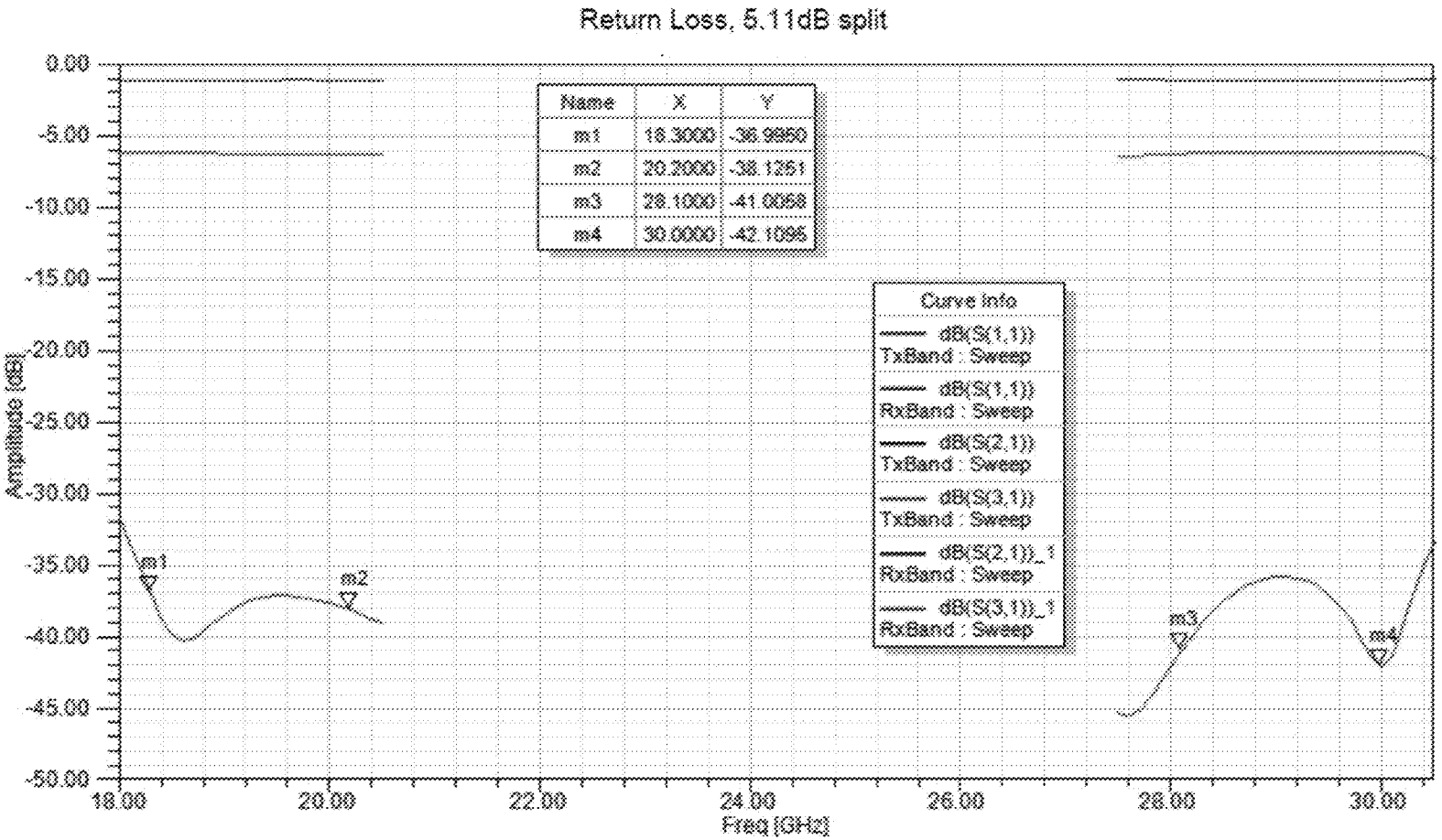
FIGS. 10-12 are graphs showing example performance results for example H-plane T-junctions with an E-plane septum.
Figure 11:
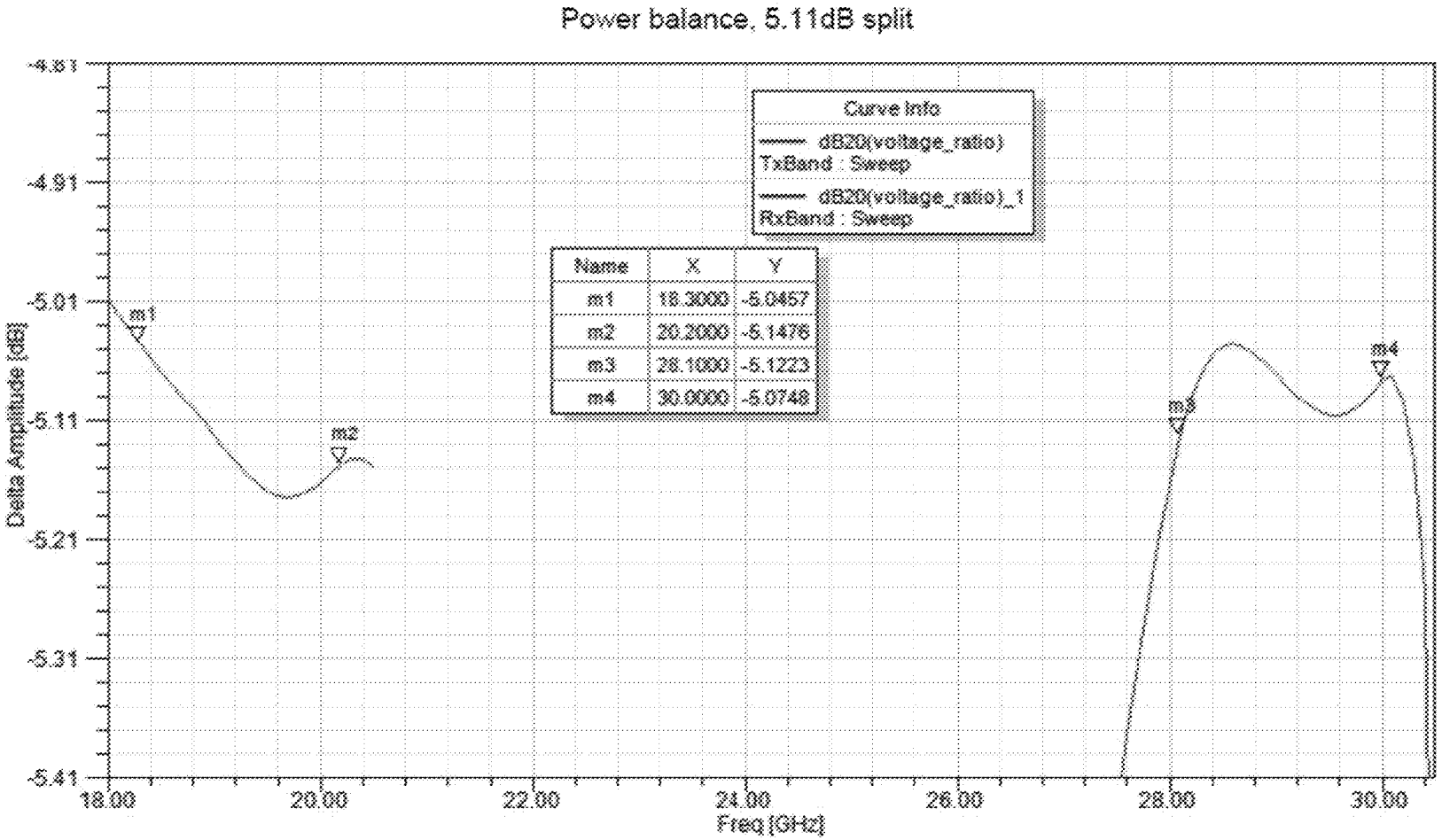
Figure 12:
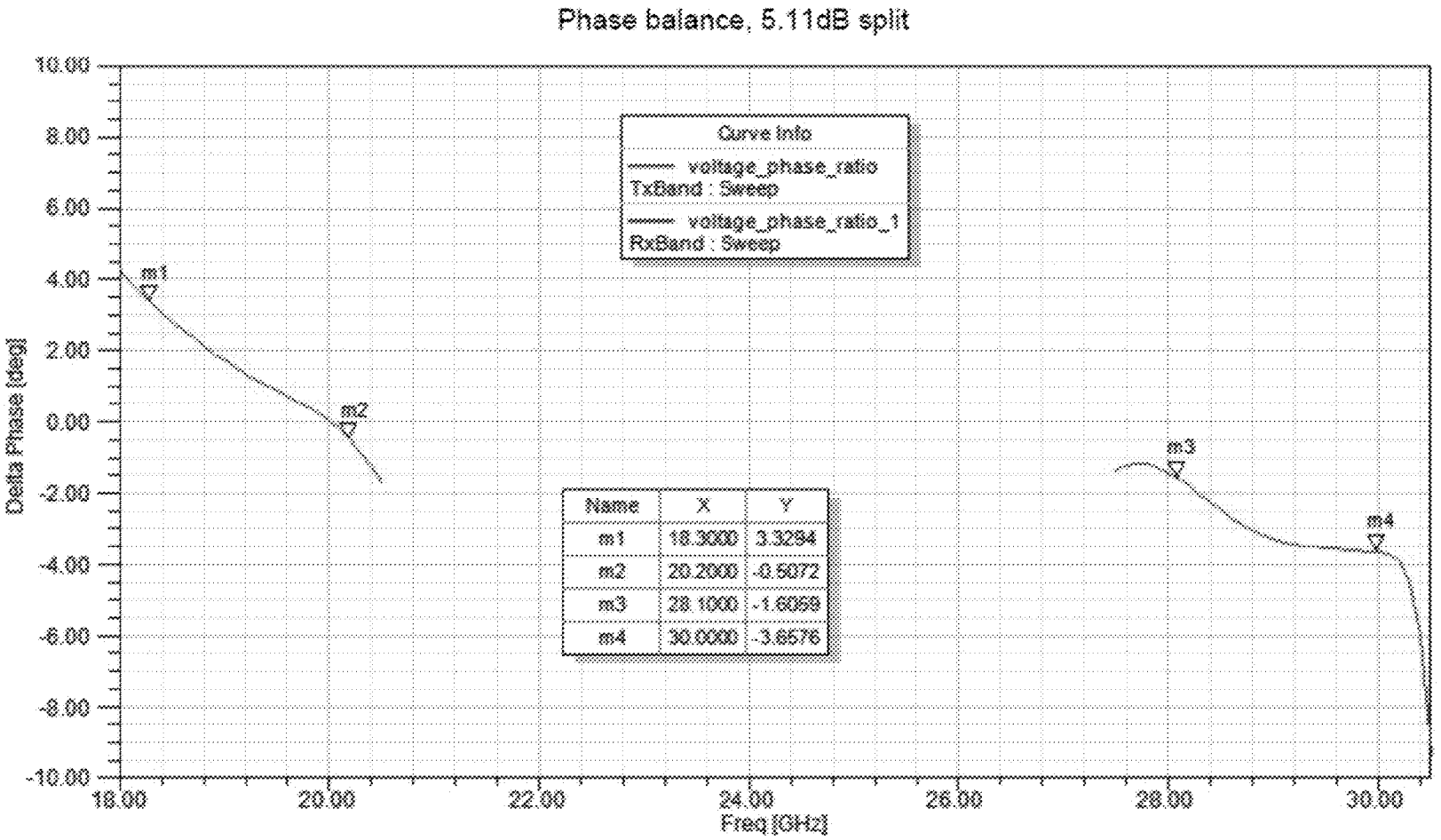

In an example embodiment, and with reference to FIG. 5, a H-plane T-junction with E-plane septum can be configured to have a 2.22 dB power split ratio. FIGS. 6-8 show the S-parameters (return loss), power balance, and phase balance for this example embodiment, which has been optimized for the commercial Ka-band (18.3-20.2 GHz, 281-30 GHz). It can be noted in FIG. 6, for example, that the return loss is comparable as between the receive frequencies and transmit frequencies. It can be noted in FIG. 7 that the power balance is comparable as between the receive frequencies and transmit frequencies, within approximately 0.1 dB. It can be noted in FIG. 8, that within each of the two frequency bands, there is relatively little variation in the phase balance, e.g., about 1 degree over the respective frequency ranges. In another example embodiment, and with reference to FIG. 9, a H-plane T-junction with E-plane septum can be configured to have a 5.11 dB power split ratio. FIGS. 10-12 show the S-parameters (return loss), power balance, and phase balance for this example embodiment, which has been optimized for the commercial Ka-band (18.3-20.2 GHz, 28.1-30 GHz). FIGS. 10-12 similarly demonstrate excellent performance parameters.

In an example embodiment, the H-plane T-junction with E-plane septum can be configured to provide excellent amplitude and phase control for equalization over a wide frequency band and high power split capability. The two examples FIGS. 11 and 12 above show less than 0.1 dB amplitude error and less than 4 degrees phase error for range of power split ratios.

Figure 13:
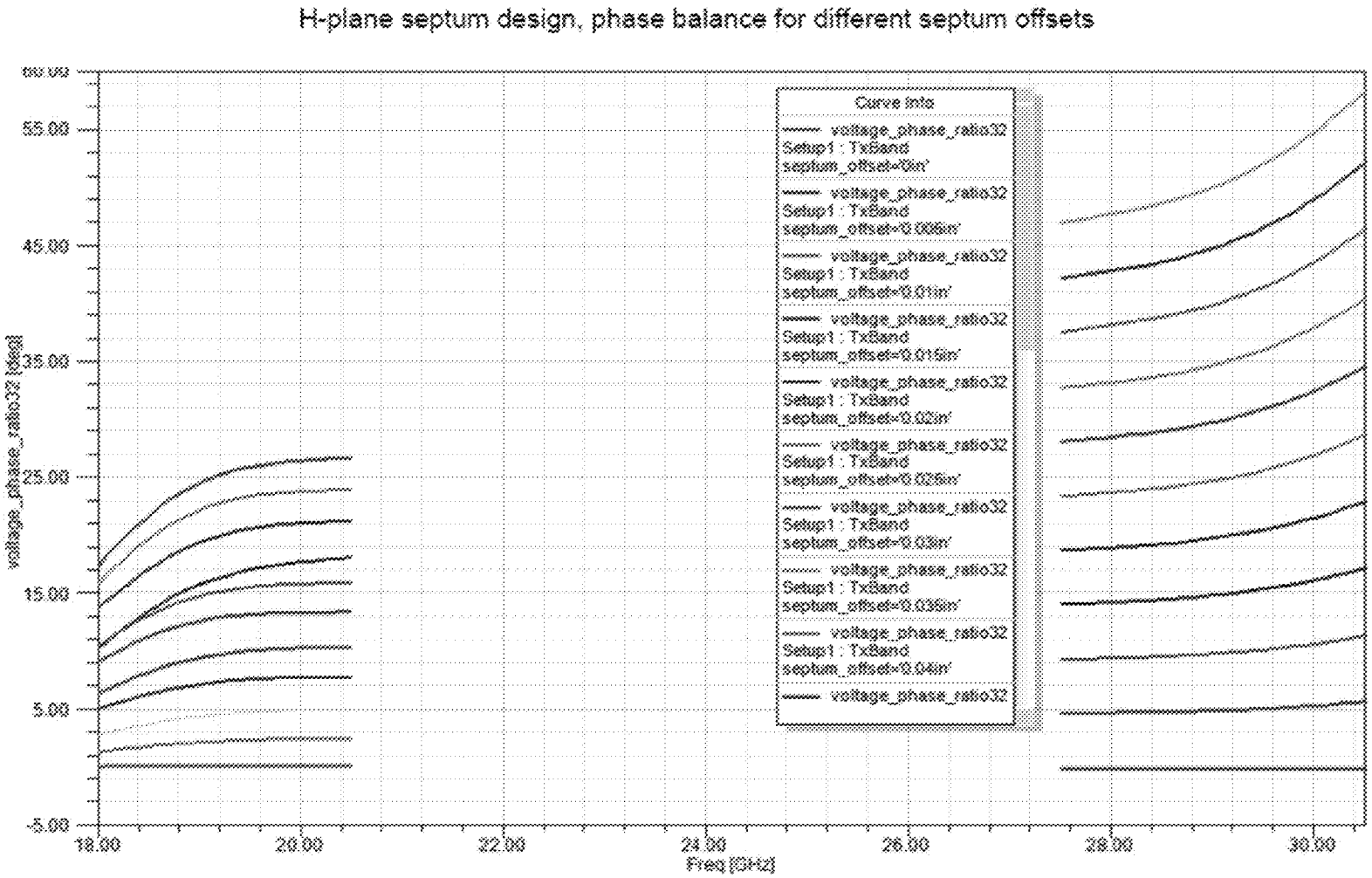
FIGS. 13-14 are graphs showing example performance results for example H-plane T-junctions with an H-plane septum.
Figure 14:
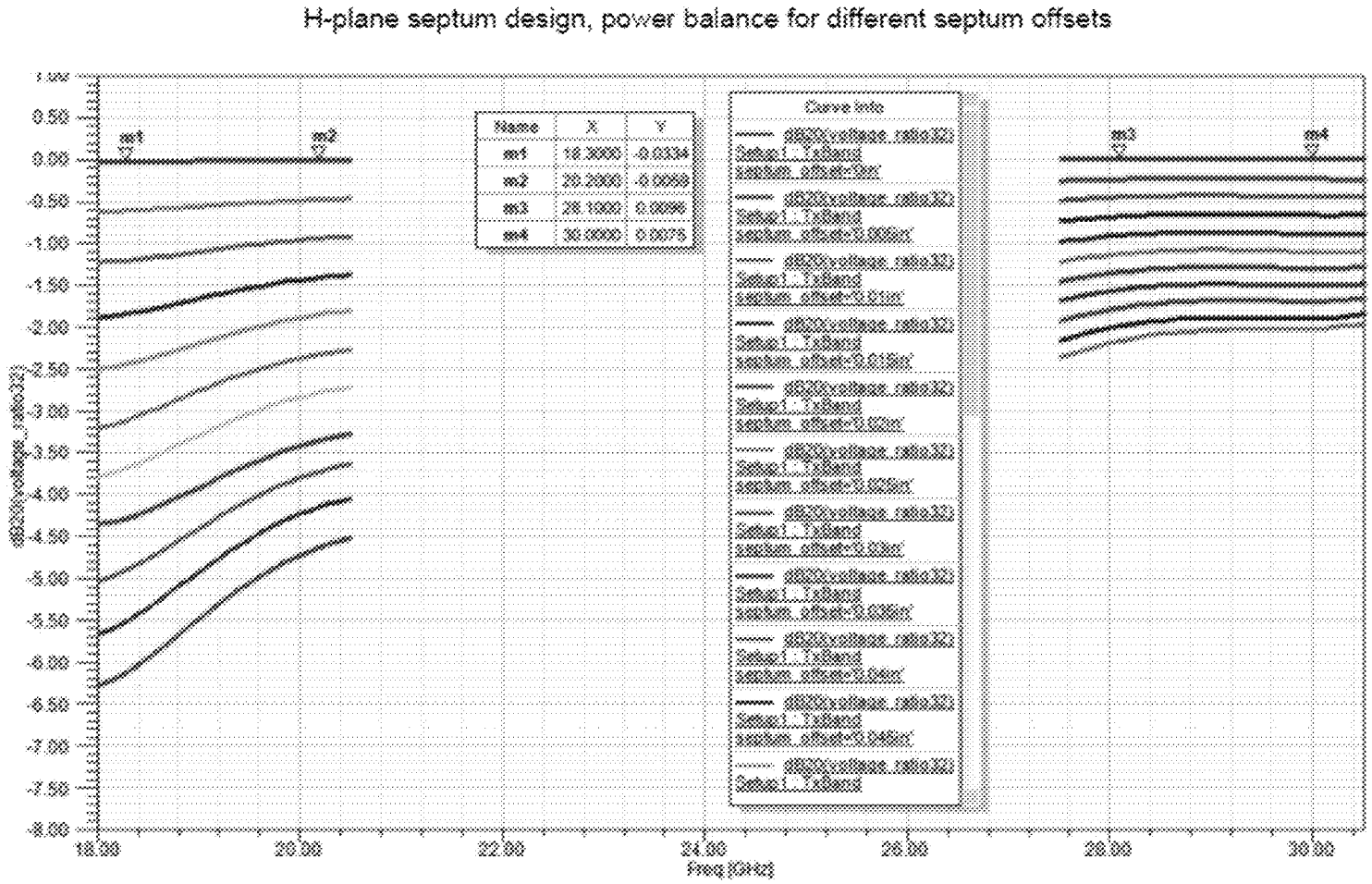
Figure 15:
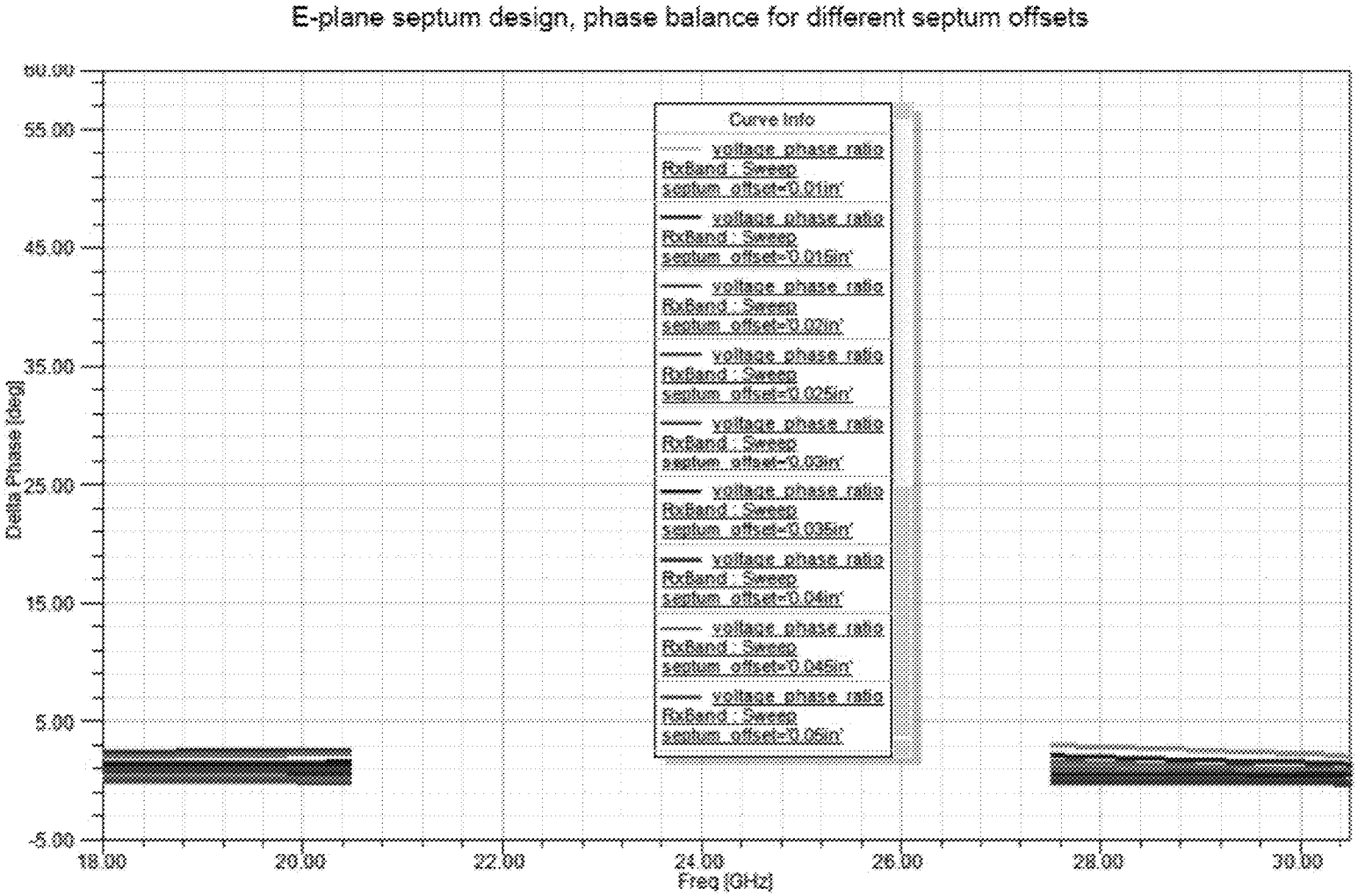
FIGS. 15-16 are graphs showing example performance results for example H-plane T-junctions with an E-plane septum for different septum offsets.
Figure 16:
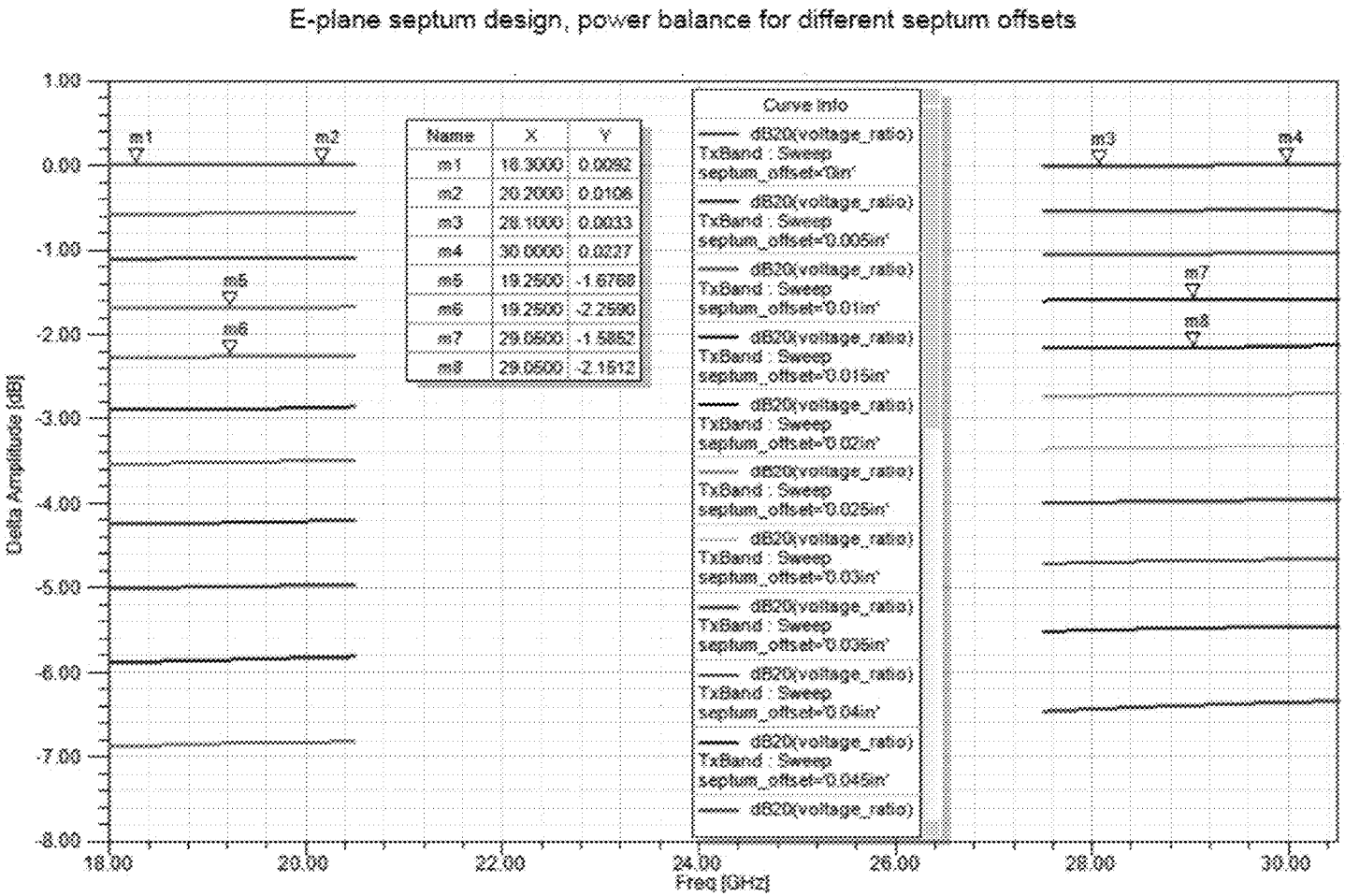

For comparison, a design with a traditional H-plane septum has been simulated for a range of septum offsets—see FIGS. 13 and 14. Here the amplitude error easily exceeds 1 dB for just modest power split ratios and the phase error exceeds 20 degrees for some larger splits ratios, in particular, the imbalance between the receive and transmit bands can be substantial and emphasizes the narrow band characteristic limitations of this traditional design. Similar simulations have been carried out for an example H-plane T-junction with E-plane septum—see FIGS. 15 and 16. This solution can exhibit a response that is nearly invariant with frequency for a wide range of power split ratios.

The thin topology may be well suited for integration into dense multi-layer beam forming networks in support of high performance array antennas. Together with the wideband operation it can enable the design of complex dual-polarized and dual-band feed networks in a compact form factor.

In accordance with another example embodiment, and with reference to FIG. 17, an H-plane T-junction 200 can comprise: a common waveguide 220 having an input port 210, a first waveguide 221 having an output port 211, a second waveguide 222 having an output port 212, and an offset asymmetric septum 250 having a non-linear shape on a first side of the offset asymmetric septum.

In an example embodiment, septum 250 can be an H-plane septum. The H-plane septum 250 can extend from the "floor" of the waveguide to the "ceiling" of the waveguide. In an example embodiment, the T-junction can be considered to have a top wall located at the top of the T structure. This top wall can be the wall facing perpendicular to the longitudinal axis of the common waveguide. The H-plane septum can extend from this "top" wall of the T, in the direction parallel to the longitudinal axis of common waveguide 220. Thus, H-plane septum 250 can be substantially vertical, or in other words parallel with the Y-Z plane. H-plane septum 250 can be configured to divide the signal from the common waveguide. The H-plane T-junction can also comprise a tuning "puck" located at the foot of the septum.

In an example embodiment, H-plane, septum 250 can be an offset septum. Thus, H-plane septum 250 can be located so that the tip of the H-plane septum can be located shifted in the positive or negative X axis direction, and/or not centered down the common waveguide. In other embodiments, H-plane septum 250 can be centered, but shaped to yet cause an unequal way power split for low power split ratios. In an example embodiment, for higher power-split ratios the H-plane septum can be both shifted and shaped. In other example embodiments, the power split can be determined by the amount the septum is offset from the center of the junction. In other words, the H-plane T-junction 200 with offset H-plane septum 250 can be configured to be an unequal way power divider/combiner.

Figure 19:
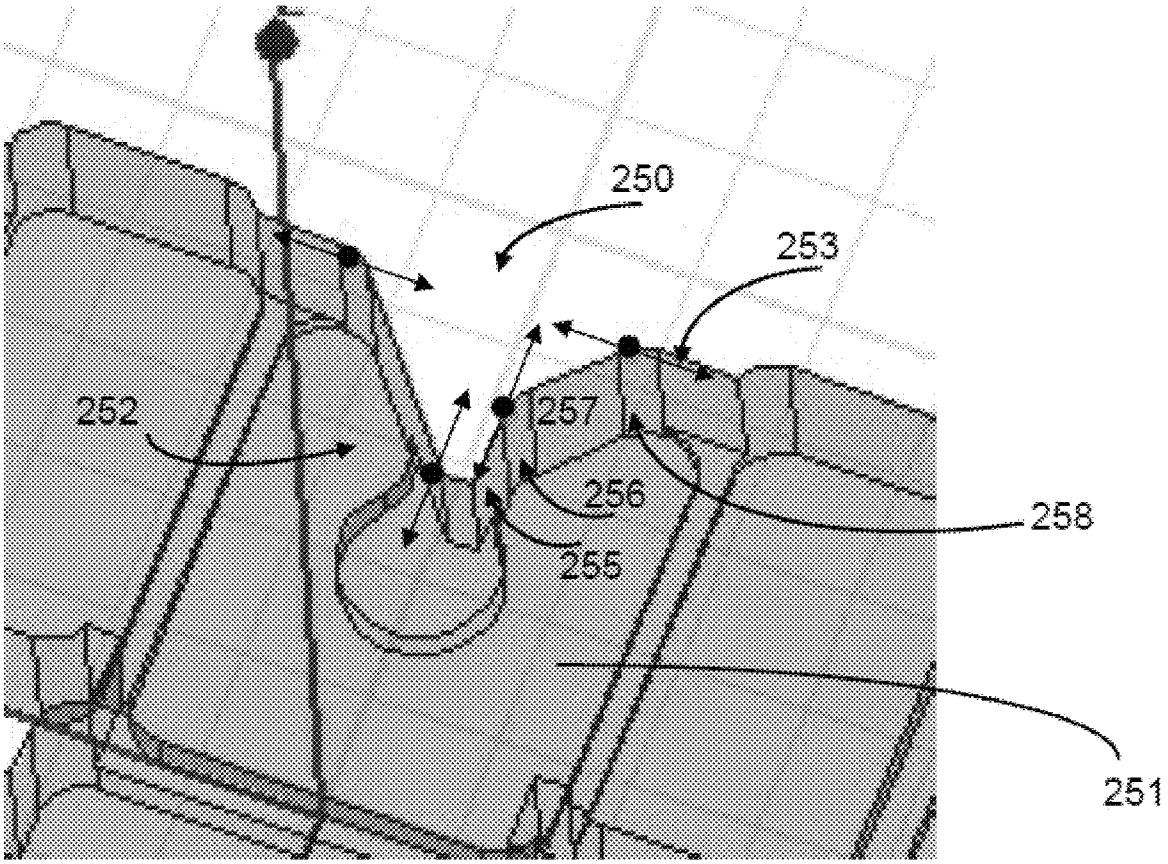
FIG. 19 is a detail perspective view of an example H-plane T-junction with a shaped H-plane septum.

In an example embodiment, H-plane septum 250 can be asymmetric shaped. This asymmetry may be described in a number of ways. With reference to FIG. 19, H-plane septum 250 can comprise a first side 251 and a second side 252. In an example embodiment, first side 251 can be substantially non-perpendicular to the top wall 253. In an example embodiment, first side 251 has a non-linear shape. The non-linear shape can be formed by use of at least one of the following geometries: non-linear, piecewise linear in two or more pieces, and curved. In the piecewise linear example, the first side 251 can comprise at least two linear segments. For example, first side 251 can comprise a first portion 255 and a second portion 257. In an example embodiment, each first and second portion can have a different angle relative to the other portions and relative to top wall 253. In between portions 255 and 257, and in between portion 257 and top wall 253, there can be radius portions (e.g., 256 and 258). The radius portions can be configured to transition between adjacent linear portions and for ease of manufacturing/machining. The tip of H-plane septum 250 can be flat for ease of manufacturing/machining. It is noted that the second side can be linear, perpendicular to the top wall, or other suitable shape, so long as it does not comprise the same shape as the first side.

It is noted that in the piece-wise linear example above, there can be four main control points (and five variables) for specifying the H-plane septum. A first control point can specify the X axis position of the intersection of the second side and the top wall. A second control point can specify the X and Y axis position of the tip of the H-plane septum. A third control point can specify the Y axis position of the intersection of first portion 255 and second portion 257. It is noted that in this example embodiment, first portion 255 is approximately perpendicular with top wall 253. A fourth control point can specify the X axis position of the intersection of second portion 257 and top wall 253. Thus, by varying these five variables associated with these four control points, the performance of the H-plane septum can be changed and designed to meet desired performance characteristics.

In another example embodiment, H-plane septum 250 can comprise first and second shoulders (251, 252), and first shoulder 251 can be shaped differently from second shoulder 252.

In another example embodiment, the H-plane septum can comprise a skirt having a first side skirt 251 of the offset asymmetric septum 250 and a second side skirt 252 of the offset asymmetric septum 250. First side skirt 251 can comprise a nonlinear shape. In an example embodiment, first side skirt 251 faces second waveguide port 212 down second waveguide 222, and second side skirt 252 laces first waveguide port 211 down first waveguide 221.

In another example embodiment, the H-plane T-junction 200 can be characterized as having a weak side and a strong side. The weak side can be characterized by either sending or receiving a low power signal relative to power of the signal received or sent on the strong side. In an example embodiment, the weak side can be associated with a weak non-common port and the strong side can be associated with a strong non-common port, wherein the weak non-common port carries a lower power radio frequency signal relative to the strong non-common port. For example, with the H-plane septum shown in FIG. 17 or 18, the first waveguide 221 can be the weak side and the second waveguide 222 can be the strong side.

In these example embodiments, the strong side of the offset shaped H-plane septum can be a non-linear shape. In various example embodiments, the weak side/second side skirt 252 can comprise a single feature, and the strong side/first side skirt 251 can comprise at least two features. In an example embodiment, the shape of the skirt on the weak side can be linear, and the shape of the skirt on the strong side can be one of: non-linear, piecewise linear in two or more pieces, and curved.

In an example embodiment, the H-plane T-junction comprises at least one iris. The at least one iris(es) can be located on the input and/or output waveguides. In an example embodiment, the iris(es) can be configured to facilitate impedance matching.

In an example embodiment, a method for building an in-phase H-plane, unequal-way, T-junction, wherein the T-junction can be at least one of a power combiner and a power divider, can comprise the operation of forming a T-junction waveguide by removing material in a metal substrate. The material can be removed to form first, second, and third waveguides. The third waveguide can comprise a common port at one end. The first and second waveguides can be arranged in a collinear arrangement and comprise first and second ports. The method further comprises forming an H-plane septum at the intersection of the first, second and third waveguides. The H-plane septum can be similarly formed by removing material from the metal substrate but leaving material where the H-plane septum is to be formed. In another embodiment, an H-plane septum can be added back into the H-plane T-junction as a press-in, brazed, bonded, soldered or similar process involving a separately manufactured septum part and a permanent installation process. The method can further comprise attaching a lid over the substrate to cover the first, second and third waveguides.

The differences between the example H-plane T-junction with offset H-plane septum and other technologies can be significant. In contrast to stripline technology, the losses can be considerably lower in the example H-plane T-junction with offset H-plane septum. And interleaved waveguide network technology and magic tee can involve more volume than in the example plane T-junction with offset H-plane septum. In contrast, the example H-plane T-junction with offset H-plane septum can be low loss, compact, and light weight and can be implemented in dense multilayer waveguide beamforming networks. It can operate in Ka band, Ku band, X band, and or the like, in air-born and terrestrial applications.

The example H-plane T-junction with offset H-plane septum can facilitate transmitting in a first band and receiving in a second band with amplitude and phase equalization within the transmit or receive bands respectively with a wide spread between them. Various examples herein illustrate example embodiments that can have dual frequency bands of 18.3 to 20.2 GHz and 28.1 to 30.0 GHz that span an overall bandwidth of (30/18.3) 1.64:1.

The H-plane T-junction with H-plane septum can be configured to maintain amplitude and phase equalization across a wide or dual frequency band. It also has great input match. Some example performance metrics can be illustrated with reference to two example H-plane T-junctions with H-plane septum. Relevant performance factors can include: low return loss (even at high frequency), power balance between the first and second ports, and phase balance between the first and second ports. Whereas prior art H-plane T-junctions may achieve common (third) port return loss values of −14.5 dB (VSWR=1.5) across a bandwidth ratio of 1.5:1, in an example embodiment, the H-plane T-junction with H-plane septum and unequal split, in an example embodiment, can be capable of better than −30 dB return loss (VSWR=1.065) on the common port across a bandwidth ratio of 1.64:1. This high degree of performance for individual junctions can be very valuable in beamforming networks comprised of multiple cascaded power combiner/dividers because it can facilitate achieving an overall net performance that can include precise phase and amplitude control that can be consistent over the operational bandwidth. Furthermore, the H-plane T-junction with shaped H-plane septum can be capable of providing this level of performance with an unequal power split and, in an example embodiment, can maintain the power split ratio with good control over the full bandwidth range. In addition, the H-plane T-junction with H-plane septum can be configured to provide a similar good control over the phase response. In an example embodiment, the excellent common (third) port return loss can facilitate such amplitude and phase responses.

Figure 18:
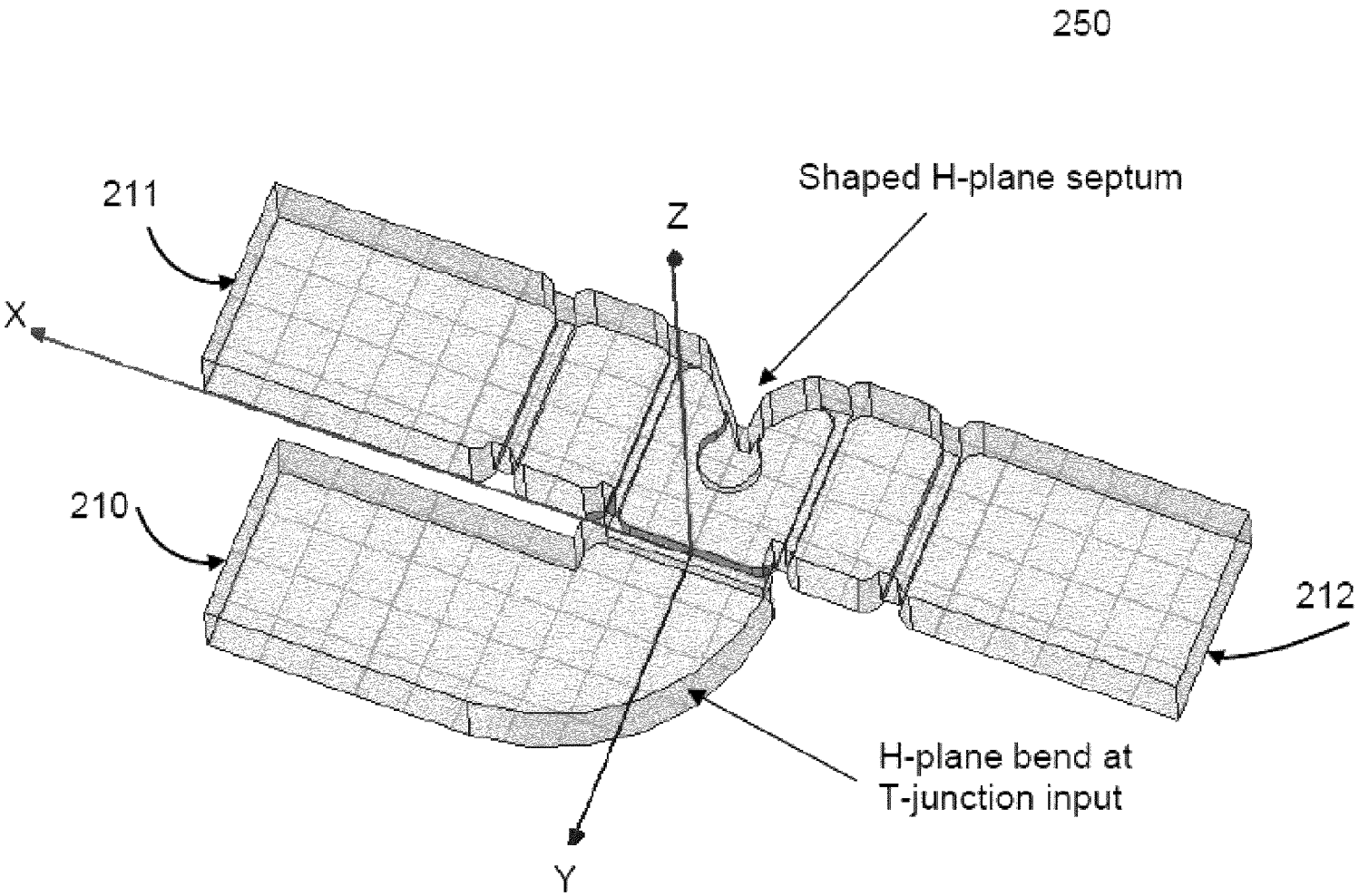
FIG. 18 is a perspective view of an example H-plane T-junction with a shaped H-plane septum and a 1.25 dB split ratio.
Figure 20:
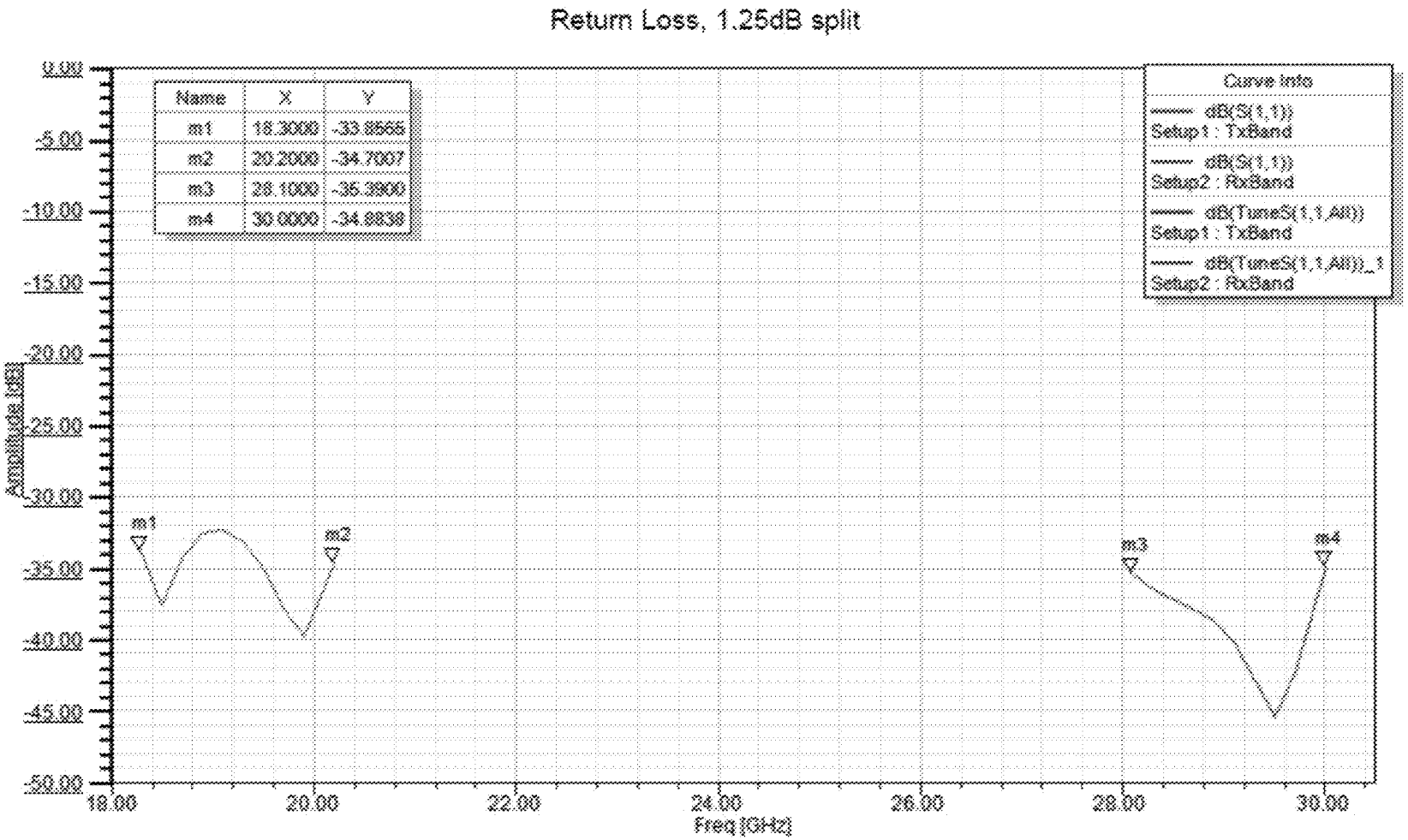
FIGS. 20-22 are graphs showing example performance results for example H-plane T-junctions with a shaped H-plane septum.
Figure 21:
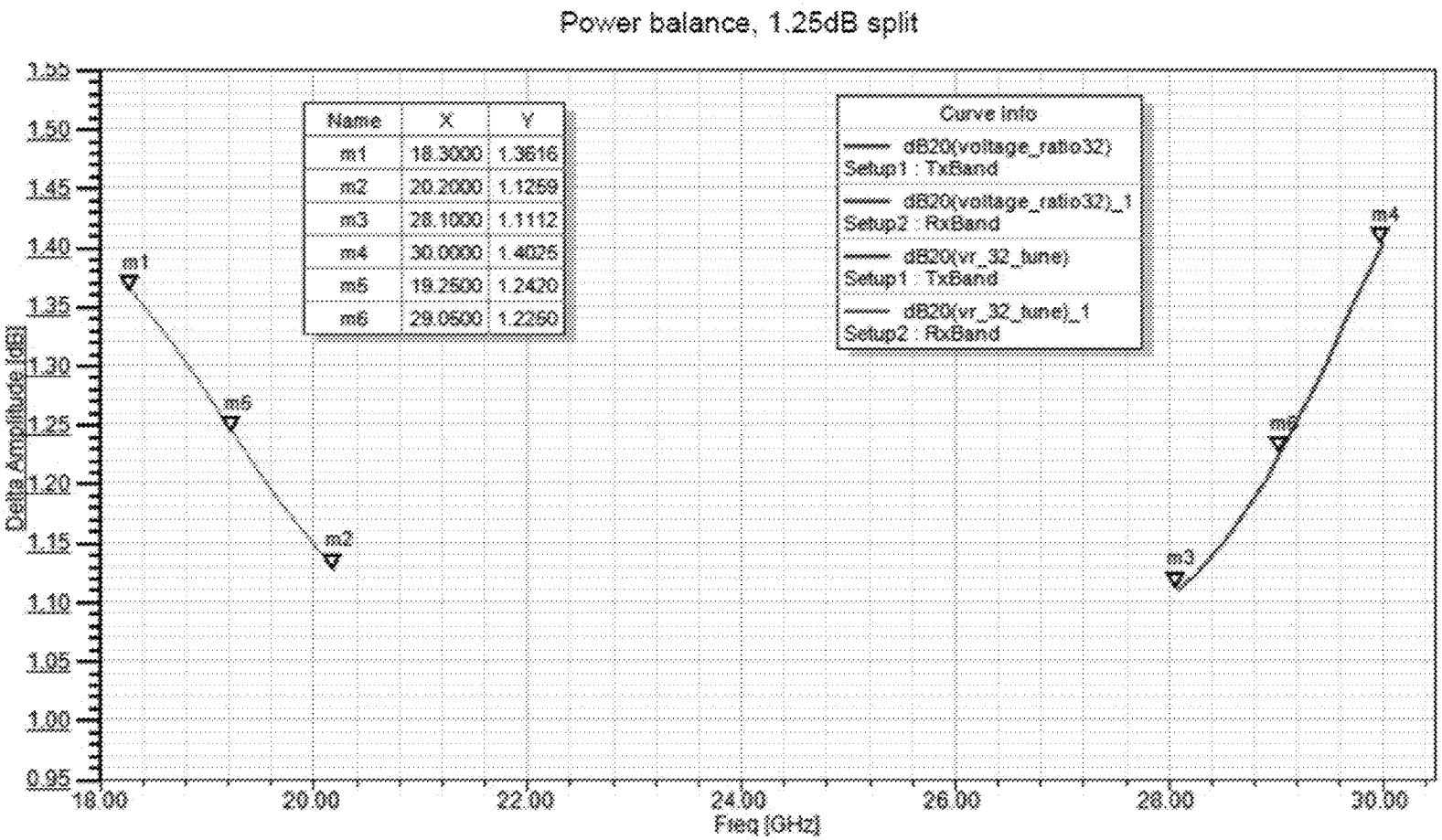
Figure 22:
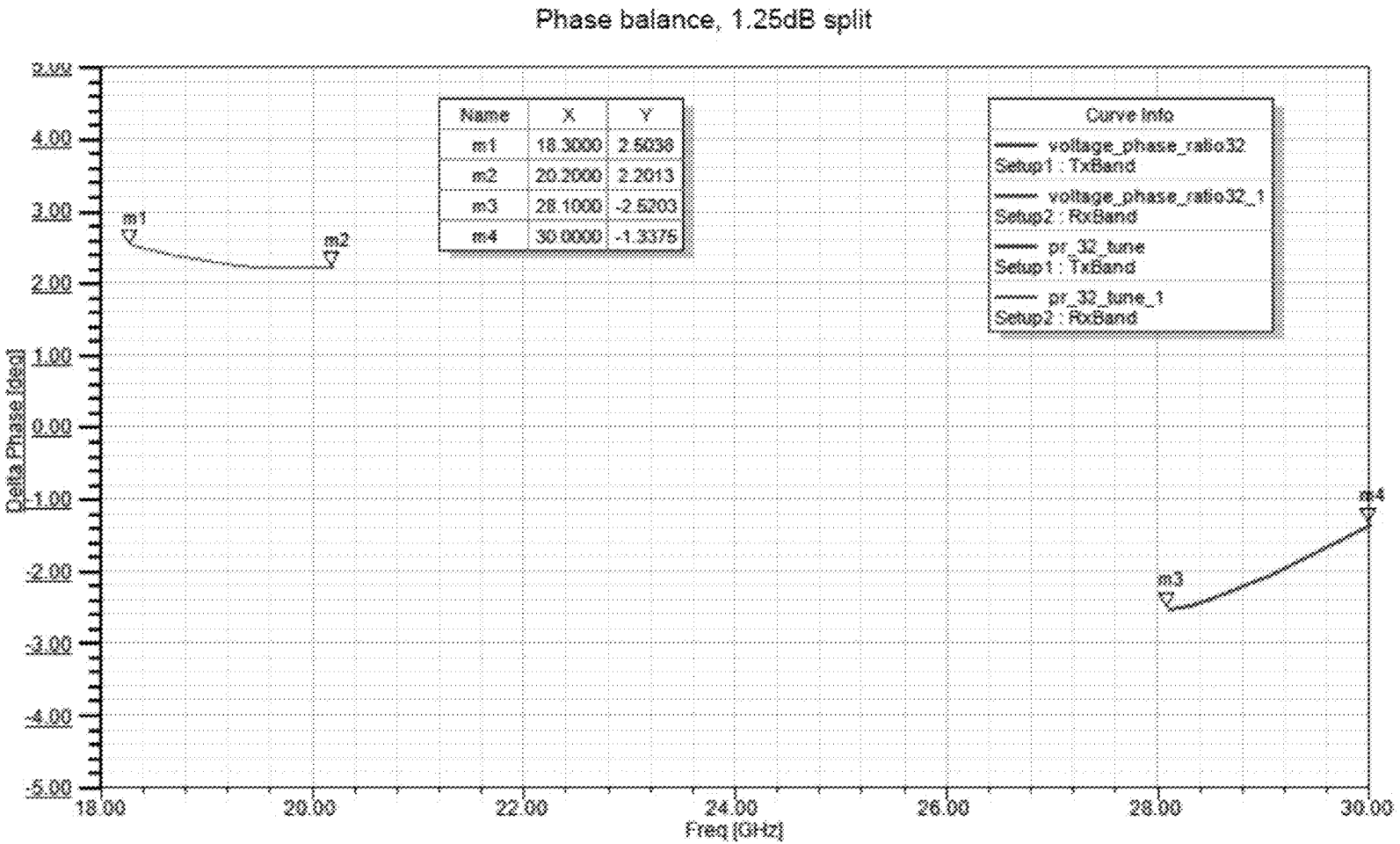

In an example embodiment, and with reference to FIG. 18, a H-plane T-junction can be configured to have a 1.25 dB power split ratio. FIGS. 20-22 show the S-parameters (return loss), power balance, and phase balance for this example embodiment, which has been optimized for the commercial Ka-band (18.3-20.2 GHz, 28.1-30 GHz). It can be noted in FIG. 20 that the return loss is comparable as between the RX and TX frequencies and can be better than −30 dB for both the RX and TX frequencies. It can be noted in FIG. 21 that the average power split ratio for the RX and TX frequencies are within less than 0.35 dB of each other. It can be noted in FIG. 22 that phase balance across RX frequencies and separately across TX frequencies is within approximately 1 degree. In other words, within the two respective frequency hands, the phase can be relatively constant across those bands.

Figure 23:
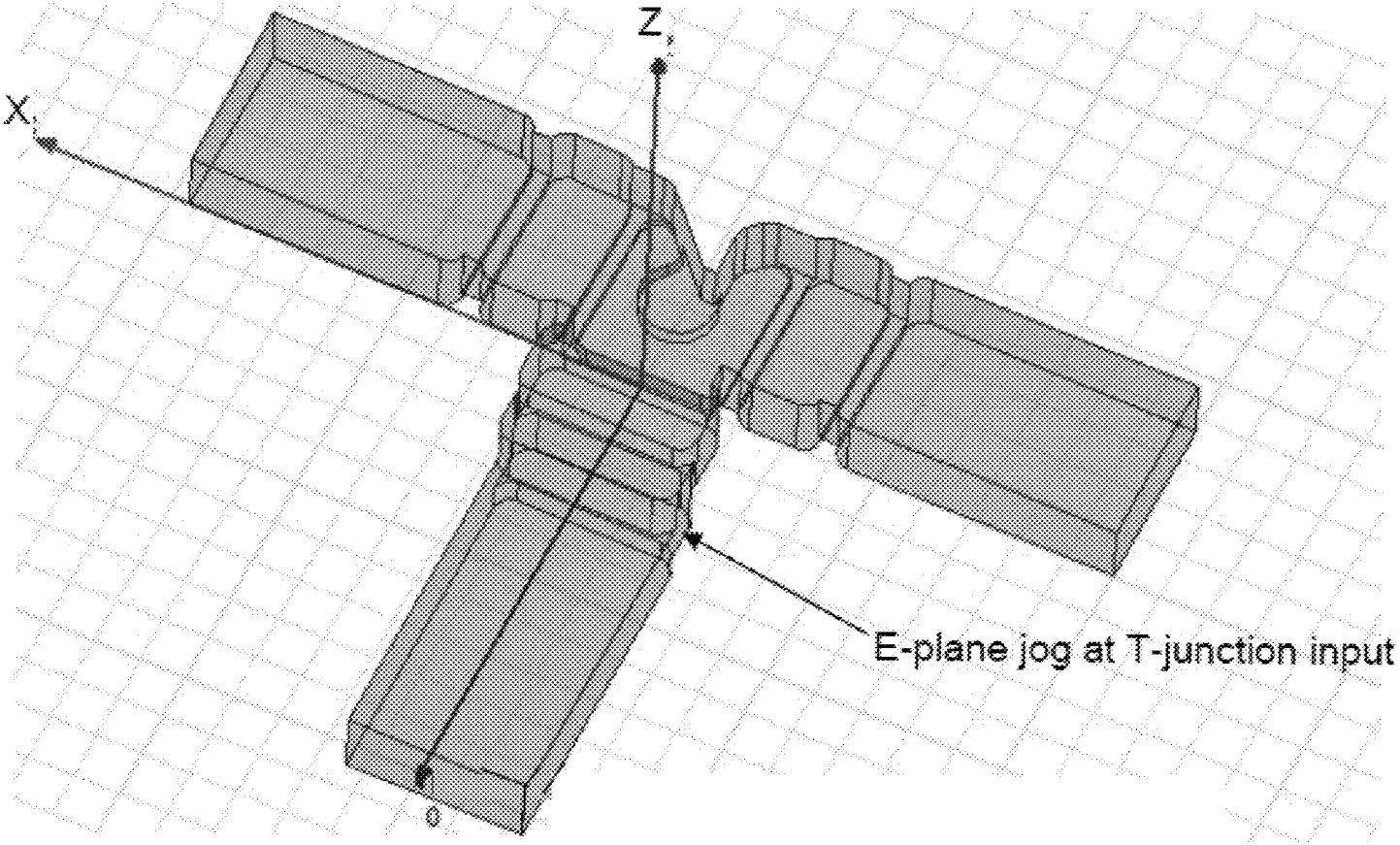
FIG. 23 is a perspective view of an example H-plane T-junction with a shaped H-plane septum and a 3 dB split ratio.
Figure 24:
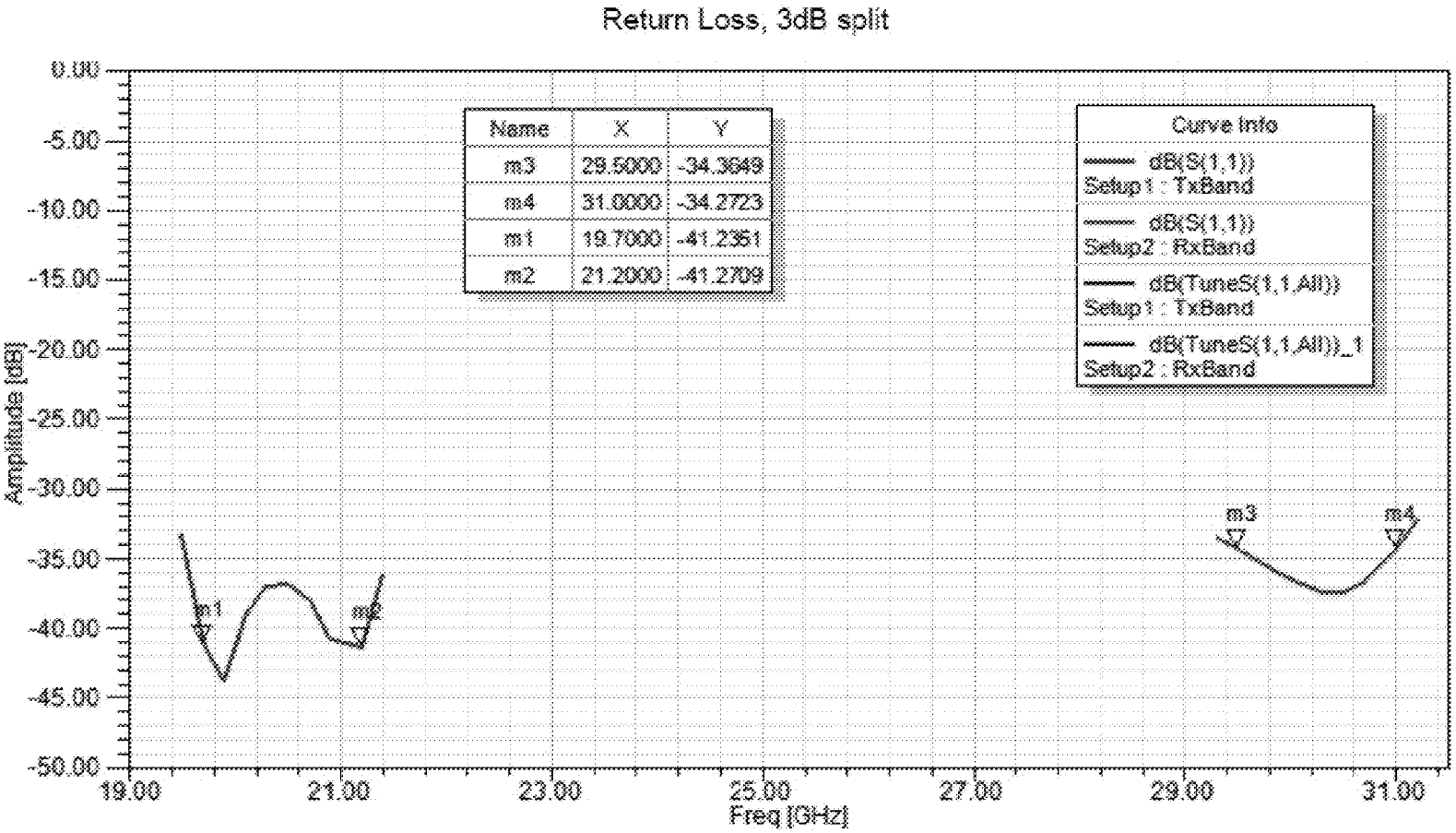
FIGS. 24-26 are graphs showing example performance results for example H-plane T-junctions with a shaped H-plane septum.
Figure 25:
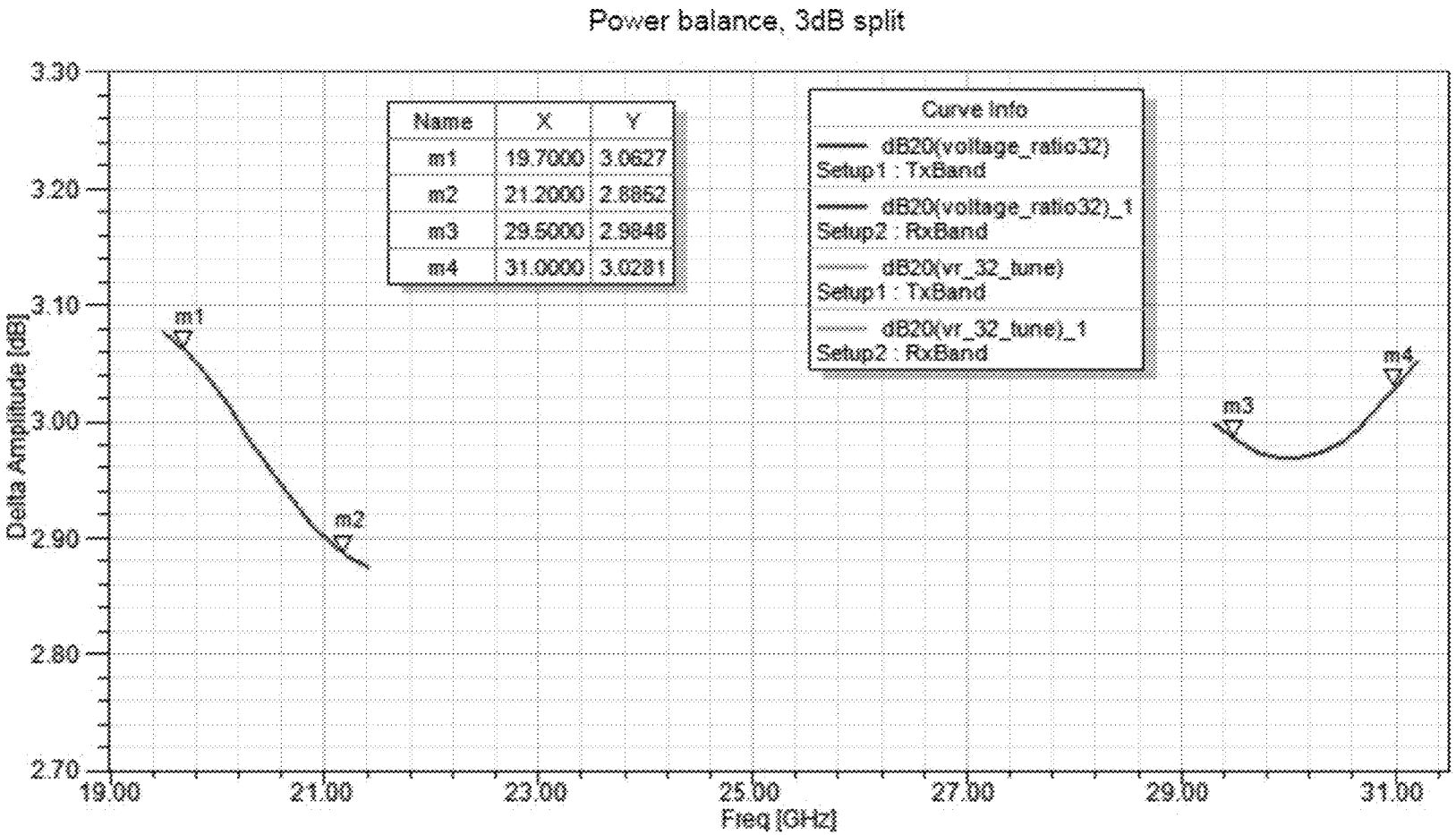
Figure 26:
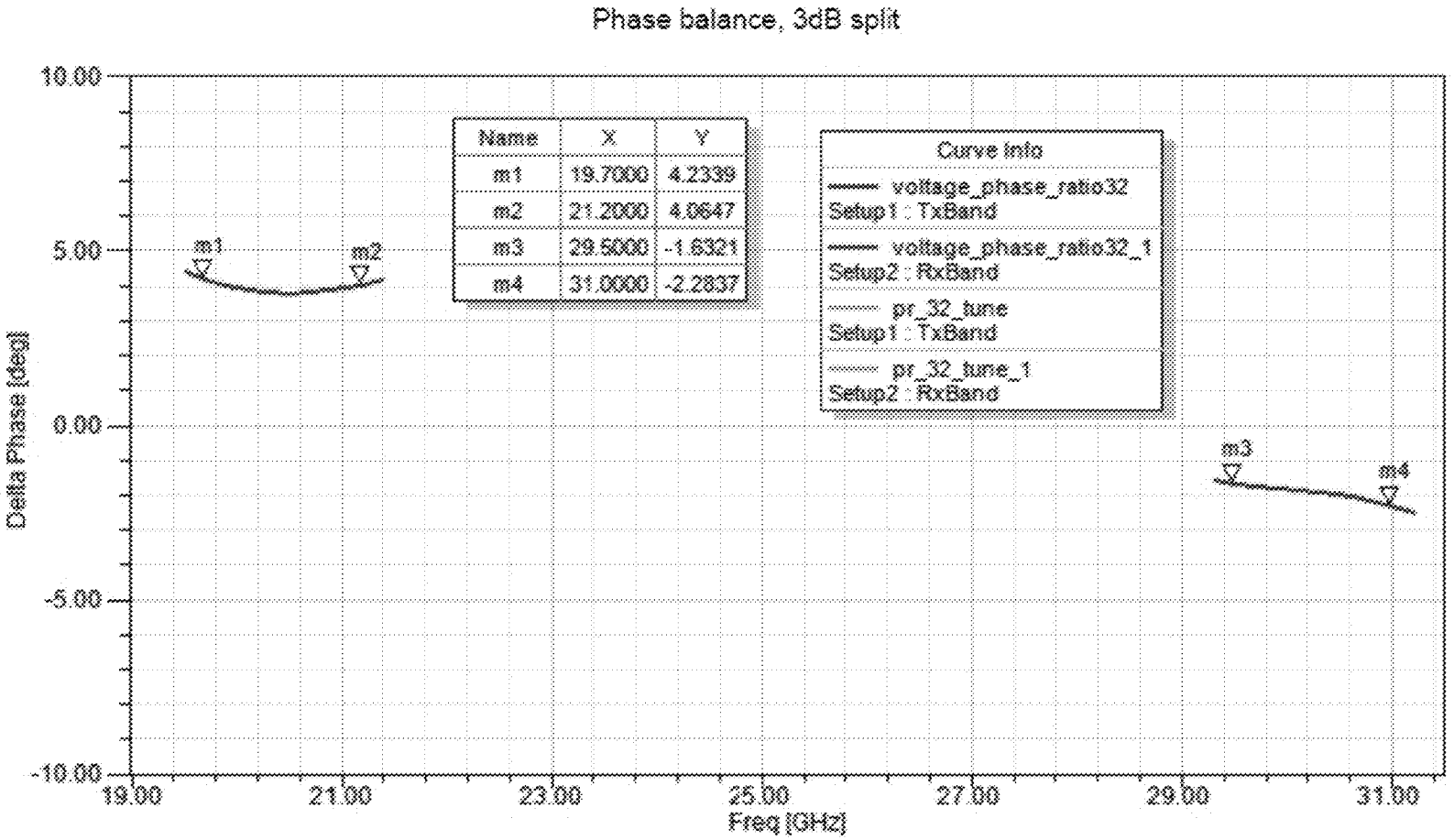

In another example embodiment, and with reference to FIG. 23, a H-plane T-junction can be configured to have a 3 dB power split ratio. FIGS. 24-26 show the S-parameters (return loss), power balance, and phase balance for this example embodiment, which has been optimized for the MIL+Ka-band (19.7-21.2 GHz, 29.5-31 GHz). Again, the modeled H-plane T-junction with 3 dB power split ratio demonstrates excellent performance.

Figure 27:
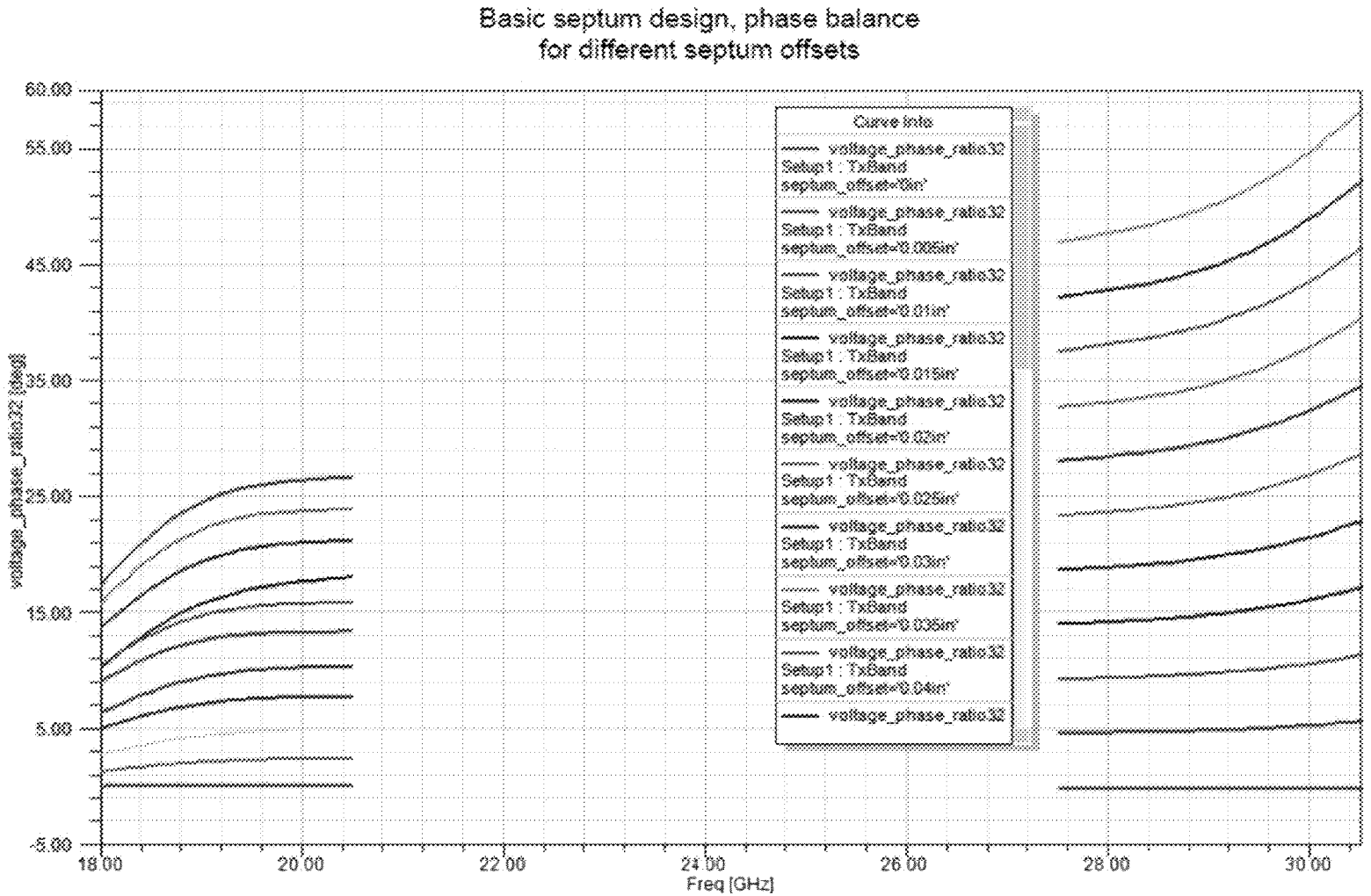
FIGS. 27-28 are graphs showing example performance results for a basic septum design.
Figure 28:
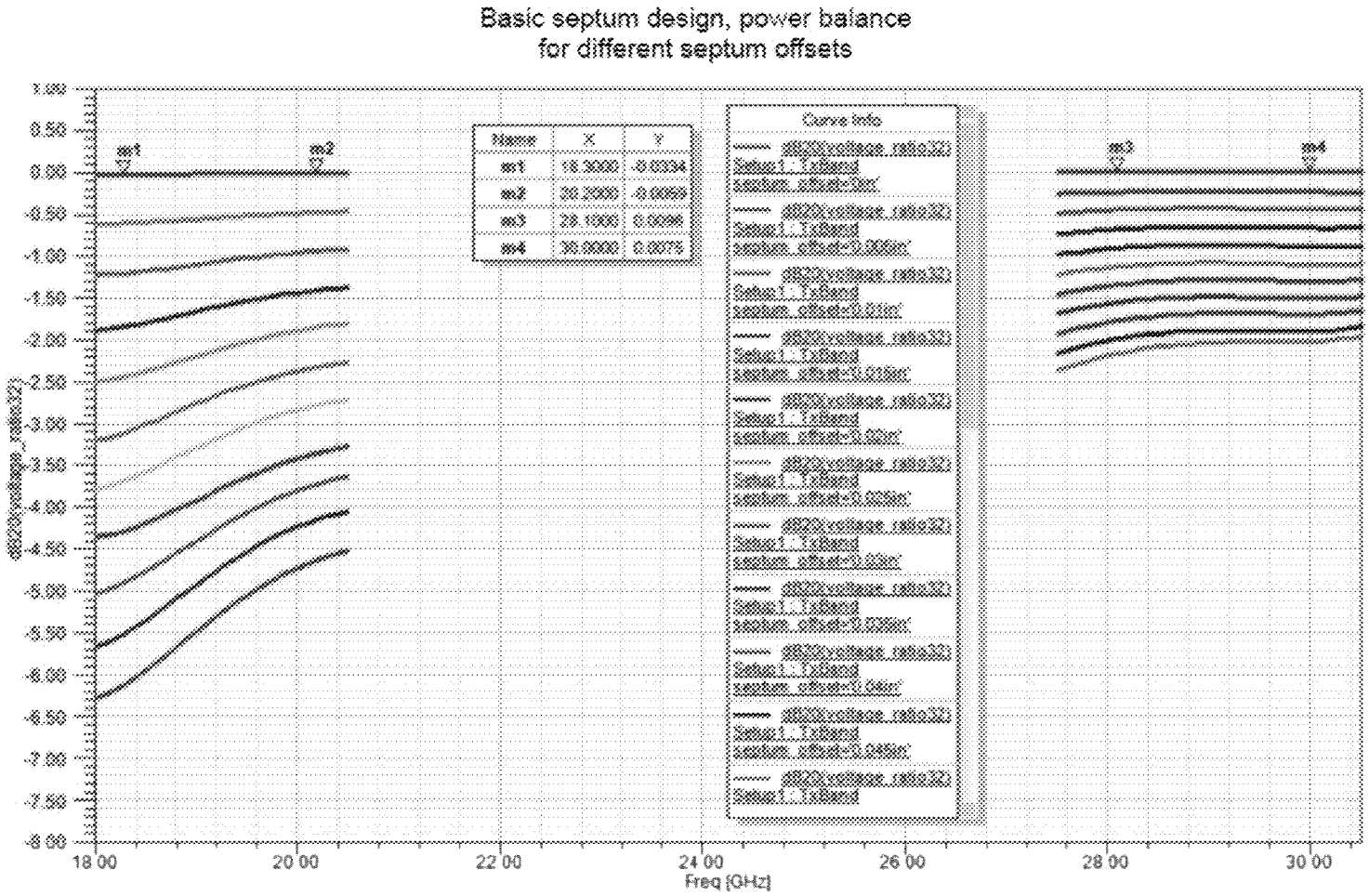

The H-plane T-junction with H-plane septum can provide much enhanced amplitude and phase control for equalization over a wide frequency band and increased power split capability. The two examples above show less than ±0.2 dB amplitude error and less than 1 degrees phase error for a range of power split ratios within TX or Rx bands. For comparison, a design with a simple septum has been simulated for a range of septum offsets see FIGS. 27 and 28. Here the amplitude error easily exceeds 1 dB for just modest power split ratios and the phase error exceeds 10 degrees within TX or RX frequency bands. In particular, the imbalance between the receive and transmit bands can be substantial and emphasizes the narrow band characteristic of prior solutions. In an example embodiment, this imbalance can prevent achieving key beamforming performance objectives over both TX and RX bands simultaneously.

In an example embodiment, the transmit signal and receive signal power can be substantially in balance. For example, within approximately −3 dB TX and −3 dB RX. In another example embodiment, the return loss can be small (e.g., −30 dB maximum dB) and the average can be similar for both TX and RX band segments. In another example embodiment, the splitter has a 1.25 dB power split, and the phase balance varies less than 1 degree over a frequency ranges from 18-20 GHz. In another example embodiment, the splitter has a 1.25 dB power split, and the phase balance varies less than 1 degree over a frequency ranges from 28-30 GHz. In another example embodiment, the splitter has a 1.25 dB power split, while the return loss can be less than −30 dB. In another example embodiment, the in-phase H-plane, unequal-way, T-junction can be a dual band device. The T-junction can be configured to maintain amplitude within each of a first band and a second band to within 0.2 dB of nominal. The T-junction can be configured to maintain phase equalization within each of the first band and second band to within 3 degrees. The T-junction can be configured such that the spread between the first band and the second band can be greater than 1.65 times the upper end of the higher of the first and the lower end of the second band.

Thus, in various example embodiments, an H-plane T-junction can comprise: a first waveguide port; a second waveguide port; and a third waveguide port. The first, second, and third waveguide ports can be in the H plane and can be each connected to each other in a T configuration, wherein the T-junction can be configured such that microwave signals in a first band are in-phase with each other at the first and second waveguide ports, and microwave signals in a second band are in-phase with each other at the first and second waveguide ports. The H-plane T-junction can be at least one of a power combiner and a power divider. Moreover, the H-plane T-junction can further comprise one of: an E-plane septum; and an offset asymmetric septum shaped with a non-linear shape on a first side of the offset asymmetric septum.

In describing the present invention, the following terminology will be used: The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" means quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but also include individual values and sub-ranges within the indicated range. Thus, included in this numerical range are individual values such as 2, 3 and 4 and sub-ranges such as 1-3, 2-4 and 3-5, etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

It should be appreciated that the particular implementations shown and described herein are illustrative of the invention and its best mode and are not intended to otherwise limit the scope of the present invention in any way. Furthermore, the connecting lines shown in the various figures contained herein are intended to represent exemplary functional relationships and/or physical couplings between the various elements. It should be noted that many alternative or additional functional relationships or physical connections may be present in a practical device.

As one skilled in the art will appreciate, the mechanism of the present invention may be suitably configured in any of several ways. It should be understood that the mechanism described herein with reference to the figures is but one exemplary embodiment of the invention and is not intended to limit the scope of the invention as described above.

It should be understood, however, that the detailed description and specific examples, while indicating exemplary embodiments of the present invention, are given for purposes of illustration only and not of limitation. Many changes and modifications within the scope of the instant invention may be made without departing from the spirit thereof, and the invention includes all such modifications. The corresponding structures, materials, acts, and equivalents of all elements in the claims below are intended to include any structure, material, or acts for performing the functions in combination with other claimed elements as specifically claimed. The scope of the invention should be determined by the appended claims and their legal equivalents, rather than by the examples given above. For example, the operations recited in any method claims may be executed in any order and are not limited to the order presented in the claims. Moreover, no element is essential to the practice of the invention unless specifically described herein as "critical" or "essential,"

Additional Example Embodiments

An example embodiment comprises an offset shaped H-plane septum having a weak side associated with a weak non-common port and having a strong side associated with a strong non-common port, wherein the weak non-common port carries a lower power radio frequency signal relative to the strong non-common port, wherein the weak side of the offset shaped H-plane septum is not a linear shape.

An example embodiment comprises an in-phase H-plane, unequal-way, T-junction comprising an offset shaped H-plane septum having a weak side associated with a weak non-common port and having a strong side associated with a strong non-common port, wherein the weak non-common port carries a lower power radio frequency signal relative to the strong non-common port, wherein the weak side of the offset shaped H-plane septum has a non-linear shape.

An example embodiment comprises the in-phase H-plane, unequal-way, T-junction further comprising: a common port; wherein the weak side is characterized by either sending or receiving a low power signal relative to power of the signal received or sent on the strong side.

An example embodiment comprises the in-phase H-plane, unequal-way, T-junction, wherein a weak side skirt of the offset shaped H-plane septum has a single feature and a strong side skirt of the offset shaped H-plane septum has at least two features.

An example embodiment comprises the in-phase H-plane, unequal-way, T-junction, wherein the offset shaped H-plane septum is an asymmetric septum that comprises a skirt and wherein the shape of the skirt on the weak side is linear, and wherein the shape of the skirt on the strong side is one of non-linear, piecewise linear in two or more pieces, and curved.

An example embodiment comprises the in-phase H-plane, unequal-way, T-junction, wherein the septum comprises first and second shoulders, and wherein the first shoulder is shaped differently from the second shoulder.

An example embodiment comprises the in-phase H-plane, unequal-way, T-junction, wherein the T-junction is a dual band device, and wherein the T-junction is configured to maintain amplitude within each of a first band and a second band to within 0.2 dB, and wherein the T-junction is configured to maintain phase equalization within each of the first band and second band to within 3 degrees, and wherein the spread between the first band and the second band is greater than 1.35 times the upper end of the higher of the first and second bands.

An example embodiment comprises the in-phase H-plane, unequal-way, T-junction, herein the T-junction is configured for simultaneously receiving and transmitting dual polarized microwave signals, and wherein the T-junction is configured such that microwave signals in a first band are in-phase with each other at the weak and strong non-common ports, and microwave signals in a second band are in-phase with each other at the weak and strong non-common ports.

An example embodiment comprises an in-phase H-plane, unequal-way, T-junction comprising: a first waveguide port; a second waveguide port; a third waveguide port, wherein the third waveguide port is a common port; and an offset asymmetric septum shaped with a non-linear shape on a first side skirt of the offset asymmetric septum; wherein the first, second, and third waveguide ports are in the H plane and are each connected to each other in a T shaped configuration; wherein the T-junction is configured such that each microwave signal at the first and second waveguide ports of the T-junction are substantially in-phase with each other; and wherein the H-plane T-junction is at least one of a power combiner and a power divider.

An example embodiment comprises the in-phase H-plane, unequal-way, T-junction, wherein the term "substantially in-phase with each other" means that in the context of the receive frequency band the signal received at the first port is in-phase with the signal received at the second port, and in the context of the transmit frequency band the signal transmitted from the first port is in-phase with the signal transmitted from the second port, and wherein the difference in frequency between the receive frequency band and the transmit frequency band is greater than 1.5.

An example embodiment comprises the in-phase H-plane, unequal-way, T-junction, wherein the first and second waveguide ports are collinear, wherein an axis is defined between the first and second waveguide ports and wherein the common port is perpendicular to the axis.

An example embodiment comprises the in-phase H-plane, unequal-way, T-junction, wherein the common port is connected to a trunk of the T-junction, wherein the first waveguide port faces the first side skirt of the offset asymmetric septum down a first branch of the T-junction, and wherein the second waveguide port faces a second side skirt of the offset asymmetric septum opposite said first side and down a second branch of the T-junction opposite the first branch of the T-junction.

An example embodiment comprises the in-phase H-plane, unequal-way, T-junction, wherein the first branch of the T-junction is a strong side and wherein the second branch of the T-junction is a weak side, wherein weak side is characterized by either sending or receiving a low power signal relative to power of the signal received or sent on the strong side.

An example embodiment comprises the in-phase H-plane, unequal-way, T-junction, wherein the weak side, the second side skirt has a single feature and the strong side, the first side skirt has at least two features.

An example embodiment comprises the in-phase H-plane, unequal-way, T-junction, wherein the offset asymmetric septum comprises a skirt and wherein the shape of the skirt on the weak side is linear, and wherein the shape of the skirt on the strong side is one of: non-linear, piecewise linear in two or more pieces, and curved.

An example embodiment comprises the in-phase H-plane, unequal-way, T-junction, wherein the septum comprises first and second shoulders, and wherein the first shoulder is shaped differently from the second shoulder.

An example embodiment comprises the in-phase H-plane, unequal-way, T-junction, wherein the T-junction is a dual hand device, and wherein the T-junction is configured to maintain amplitude within each of a first band and a second band to within 0.2 dB, and wherein the T-junction is configured to maintain phase equalization within each of the first band and second band to within 3 degrees, and wherein the spread between the first band and the second band is greater than 1.35 times the upper end of the higher of the first and second bands.

An example embodiment comprises the in-phase H-plane, unequal-way, T-junction, wherein the T-junction is configured for simultaneously receiving and transmitting dual polarized microwave signals.

An example embodiment comprises a method for building an in-phase H-plane, unequal-way, T-junction, wherein the T-junction is at least one of a power combiner and a power divider, the method comprising: forming a T-junction waveguide by removing material in a metal substrate to form first, second, and third waveguides, wherein the third waveguide has a common port at one end, and wherein the first and second waveguides are arranged in a collinear arrangement and comprise first and second ports; forming an H-plane septum at the intersection of the first, second and third waveguides, wherein the H-plane septum is offset and asymmetric, and wherein the H-plane septum is shaped with a non-linear shape on a first side of the septum; and attaching a lid over the substrate to cover the first, second and third waveguides. The method further comprising forming the non-linear shape on the first side of the septum by use of at least one of the following geometries; non-linear, piecewise linear in two or more pieces, and curved. The method further comprising forming at least one iris(es) in at least one of the first, second, and third waveguides.

An example embodiment comprises an in-phase H-plane, unequal-way, T-junction comprising an offset asymmetric shaped H-plane septum, the T-junction comprising a top wall forming the "top" of the T-junction and opposite a common waveguide channel. Wherein a first side of the offset asymmetric shaped H-plane septum is substantially non-perpendicular to the top wall, and wherein the H-plane T-junction is at least one of a power combiner and a power divider.

An example embodiment comprises an in-phase H-plane, unequal-way, T-junction comprising an offset asymmetric shaped H-plane septum, wherein a first side of the offset asymmetric shaped H-plane septum comprises more than one portion with each portion having a different angle relative to each other, and wherein the H-plane T-junction is at least one of a power combiner and a power divider.

What is claimed is:

1. A waveguide junction comprising:

a first waveguide coupled between a common port of the waveguide junction and an E-plane septum, the E-plane septum dividing the first waveguide into a top waveguide portion and a bottom waveguide portion, wherein the E-plane septum includes a shaped leading edge to provide impedance matching between the common port of the waveguide junction and the top and bottom waveguide portions respectively;

a second waveguide comprising a first H-plane bend coupled between the top waveguide portion and a first coupled port of the waveguide junction; and a third waveguide comprising a second H-plane bend coupled between the bottom waveguide portion and a second coupled port of the waveguide junction.

2. The waveguide junction of claim 1, wherein the first H-plane bend and the second H-plane bend curve in opposite directions away from the first waveguide.

3. The waveguide junction of claim 2, wherein the first waveguide, the second waveguide and the third waveguide are connected in a T configuration.

4. The waveguide junction of claim 1, wherein a power split ratio between the second and third waveguides is based on a cross-sectional area ratio of the top and bottom waveguide portions.

5. The waveguide junction of claim 1, wherein:

the second waveguide includes a first transition section coupled between the first H-plane bend and the first coupled port, the first transition section increasing a height of the second waveguide such that the height of the second waveguide and the height of the first waveguide are equal; and the third waveguide includes a second transition section coupled between the second H-plane bend and the second coupled port, the second transition section increasing a height of the third waveguide such that the height of the third waveguide is equal to the height of the first waveguide.

6. The waveguide junction of claim 5, wherein:

the first transition section increases the height of the second waveguide along a first direction; and the second transition section increases the height of the third waveguide along a second direction, the second direction opposite to the first direction.

7. The waveguide junction of claim 5, wherein an H-plane evenly bisects the first coupled port and the second coupled port.

8. The waveguide junction of claim 5, wherein signals within the second waveguide and the third waveguide propagate along the same axis and in opposite directions.

9. The waveguide junction of claim 1, wherein cross-sectional areas of the top and bottom waveguide portions are each less than a cross-sectional area of the first waveguide.

10. The waveguide junction of claim 9, wherein a sum of the cross-sectional areas of the top and bottom waveguides is less than the cross-sectional area of the first waveguide.

11. The waveguide junction of claim 1, wherein the first waveguide, the top waveguide portion and the second waveguide portion each have widths that are equal.

12. The waveguide junction of claim 1, wherein:

a first signal path from the common port to the first coupled port extends along a first direction through the second waveguide;

a second signal path from the common port to the second coupled port extends along a second direction through the third waveguide.

13. The waveguide junction of claim 12, wherein the first direction is opposite the second direction.

14. The waveguide junction of claim 1, wherein the E-plane septum divides an input signal in the first waveguide into a first divided signal in the top waveguide portion and a second divided signal in the bottom waveguide portion.

15. The waveguide junction of claim 14, wherein the first divided signal and the second divided signal are in-phase with respect to one another.

16. The waveguide junction of claim 1, wherein the E-plane septum combines a first input signal from the second waveguide and a second input signal from the third waveguide to form an output signal in the first waveguide.

17. The waveguide junction of claim 16, wherein the E-plane septum combines the first input signal and the second input signal in-phase.

18. The waveguide junction of claim 1, wherein the first H-plane bend and the second H-plane bend are each 90 degree bends.

19. The waveguide junction of claim 1, wherein the first, second and third waveguides are each rectangular waveguides.

* * * * *